US008232033B2

(12) United States Patent
Tsubaki et al.

(10) Patent No.: US 8,232,033 B2
(45) Date of Patent: Jul. 31, 2012

(54) TONER, METHOD OF MANUFACTURING TONER, DEVELOPER, TWO-COMPONENT DEVELOPER, DEVELOPING DEVICE, AND IMAGE FORMING APPARATUS

(75) Inventors: Yoritaka Tsubaki, Nara (JP); Hiroshi Onda, Yamatokoriyama (JP); Yasuo Imura, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 424 days.

(21) Appl. No.: 12/389,519

(22) Filed: Feb. 20, 2009

(65) Prior Publication Data

US 2009/0214264 A1 Aug. 27, 2009

(30) Foreign Application Priority Data

Feb. 21, 2008 (JP) ..... P2008-040679
Jun. 9, 2008 (JP) ..... P2008-151115

(51) Int. Cl.
*G03G 9/00* (2006.01)

(52) U.S. Cl. ..... 430/108.1; 430/108.8; 430/110.1; 430/110.3; 430/137.2

(58) Field of Classification Search ..... 430/108.1, 430/108.8, 110.1, 110.2, 111.4, 110.3, 137.1, 430/137.2
See application file for complete search history.

(56) References Cited

U.S. PATENT DOCUMENTS

| | | | | |
|---|---|---|---|---|
| 5,512,406 | A | 4/1996 | Takeda | |
| 5,843,605 | A * | 12/1998 | Anno et al. | 430/108.23 |
| 7,459,254 | B2 * | 12/2008 | Yuasa et al. | 430/110.1 |
| 2003/0022084 | A1 * | 1/2003 | Sugiyama et al. | 430/108.1 |
| 2005/0208403 | A1 * | 9/2005 | Shu et al. | 430/108.1 |
| 2006/0056888 | A1 | 3/2006 | Sugiyama et al. | |
| 2006/0177755 | A1 | 8/2006 | Toizumi et al. | |
| 2007/0026335 | A1 * | 2/2007 | Yamamoto et al. | 430/108.8 |
| 2008/0070145 | A1 * | 3/2008 | Onda et al. | 430/110.4 |

FOREIGN PATENT DOCUMENTS

| | | | |
|---|---|---|---|
| JP | 6-059494 | A | 3/1994 |
| JP | 7-160037 | A | 6/1995 |
| JP | 09-319143 | | 12/1997 |
| JP | 09-319158 | | 12/1997 |
| JP | 2000-242026 | A | 9/2000 |
| JP | 2003-270852 | A | 9/2003 |
| JP | 2005-234410 | A | 9/2005 |
| JP | 2006-047694 | A | 2/2006 |
| JP | 2006-106710 | A | 4/2006 |
| JP | 2006-220866 | A | 8/2006 |
| JP | 2008-020578 | | 1/2008 |

* cited by examiner

*Primary Examiner* — Mark F Huff
*Assistant Examiner* — Stewart Fraser
(74) *Attorney, Agent, or Firm* — Nixon & Vanderhye P.C.

(57) ABSTRACT

A toner, a developer, a two-component developer, a developing device and an image forming apparatus are provided. In the image forming apparatus, images are formed with a developer that fills a developing tank of the developing device. The developer includes the toner containing at least a binder resin, a colorant, and a release agent, the release agent having an acid value of less than 4 mgKOH/g and in which an amount of the release agent exposed on a surface of toner is 0.5% by weight or more and 2.5% by weight or less of a total amount of the toner.

12 Claims, 3 Drawing Sheets

TONER, METHOD OF MANUFACTURING TONER, DEVELOPER, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application Nos. 2008-040679 and 2008-151115, which were filed on Feb. 21, 2008 and Jun. 9, 2008, the contents of which are incorporated herein by reference in its entirety.

BACKGROUND OF THE-INVENTION

1. Field of the Invention

The present invention relates to a toner, a method of manufacturing the toner, a developer, a two-component developer, a developing device, and an image forming apparatus having the developing device.

2. Description of the Related Art

A toner is used to visualize a latent image in various image forming processes, and one known example thereof is an electrophotographic image forming process.

An electrophotographic image forming apparatus forming images in the electrophotography process is capable of easily forming images with high quality and therefore is widely used for copiers, printers, facsimile machines, and the like equipment.

The electrophotographic image forming apparatus (hereinafter referred to simply as "image forming apparatus") includes, for example, a photoreceptor, a charging section, a exposing section, a developing section, a transfer section, a fixing section, an electricity removing section, and a cleaning section. The image forming apparatus is an apparatus which uses the photoreceptor and those sections stated above to form an image on a recording medium through a charging step, an exposing step, a developing step, a transferring step, a fixing step, a cleaning step, and an electricity removing step.

In the charging step, a photoreceptor surface is homogeneously charged by the charging section. In the exposing step, the exposing section is used to expose the charged photoreceptor so that an electrostatic latent image is formed on the photoreceptor surface. In the developing step, the electrostatic latent image formed on the photoreceptor surface is developed with use of a toner contained in a developer, and a visualized image is thereby formed. To be specific, the developing section attaches the charged toner to the electrostatic latent image formed on the photoreceptor surface, thereby forming the visualized image on the photoreceptor surface. In the transferring step, the visualized image formed on the photoreceptor surface is transferred by the transfer section onto a recording medium such as paper or a sheet. In the fixing step, the visualized image transferred to the recording medium is fixed thereto with heat or pressure by the fixing section. In the cleaning step, a transfer residual toner remaining on the photoreceptor surface after the transferring step is removed by the cleaning section. In the electricity removing step, the charges in the photoreceptor surface are removed by the electricity removing section to be ready for next image formation. The visualized image may be firstly transferred to an intermediate transfer medium from which the image will be then-transferred to the recording medium.

The developer to be used to form the visualized image includes a two-component developer made of a carrier and a toner, and a one-component developer made of only a toner.

In the two-component developer, the toner and the carrier are mixed with each other to give charges to the toner, and it is therefore necessary to provide a stirring mechanism for mixing the toner and the carrier evenly, which results in a disadvantage that the developing device will have more a complicated structure. The two-component developer however exhibits excellent toner charging stability and compatibility with a high-speed apparatus. This is why the two-component developer is often used in a high-speed image forming apparatus and a color-image forming apparatus.

The one-component developer contains no carrier and therefore does not require the stirring mechanism for mixing the toner and the carrier evenly. The one-component developer therefore has an advantage that a developing device serving as the developing section has a simple structure. However, the toner is charged by friction with a plate-like blade made of metal or resin, which results in a disadvantage that a charge amount of the toner will be barely stable.

In order to enhance the quality of images formed by the image forming apparatus, studies have been made, for example, on the use of the toner having shape-controlled small particles. Such a toner as being composed of shape-controlled particles has however a problem that in the case of forming an image on a rough-surfaced recording medium, the resultant image will have low quality.

The toner contains a release agent, for example, to prevent an offset phenomenon that the toner on the recording medium adheres to the fixing section in the fixing step. In forming an image, the release agent existing in a surface of the toner become more soluble as an internal temperature of a developing tank rises by rotation of a developing roller in the developing tank, and the release agent exposed on the surface of toner becomes a center of adherence of the toner to a charge applying material which is, for example, a carrier in the case of the two-component developer, or a regulating blade in the case of the one-component developer. Further, the heat of the fixing device also increases the internal temperature of the developing tank. The above adherence is higher as the developer is exposed to a high temperature for longer hours and as a larger area of the release agent exposed on the surface of the toner makes contact with the charge applying material.

As described above, when the amount of the release agent exposed on the surface of toner increases due to the shape control of toner particles, the toner and carrier in the developer will start to aggregate from the part of release agent exposed on the surface of toner, and such aggregation will deteriorate flowability of the developer, or will cause the release agent to be fused and fixed to the regulating blade. In this state, the toner consequently exhibits a lower developing property and thus forms images with lower quality. Especially for the rough-surfaced recording medium to which images are less smoothly transferred than a smooth-surface recording medium, images formed on such rough-surface recording mediums will have still lower quality.

In order to solve the above problems, Japanese Unexamined Patent Publication JP-A 9-319158 (1997) discloses a developer consisting of a carrier and a toner, the carrier being composed of a core material and a resin-coating layer deposited on the core material, the resin-coating layer having dispersion of resin fine particles of melamine, guanamine, or the like resin containing nitrogen atoms, and the toner containing a binder resin, a colorant, and wax, wherein an amount of the wax exposed on a surface of toner is 15% by weight to 40% by weight, and wherein $40 \leqq X \times Y \leqq 240$ is satisfied where X represents an amount of the wax exposed on the surface of toner and Y represents an amount of the wax contained in the toner. According to JP-A 9-319158, it is possible to obtain an electrostatic latent image developer having good flowability and a very long life with less environmental dependency, which developer is capable of reducing toner spent to the carrier, toner blocking, or fusing onto the regulating blade, and able to be fixed over a broad temperature range.

Further, Japanese Unexamined Patent Publication JP-A 2008-20578 discloses an electrostatic charge image developing toner containing toner base particles containing a binder resin and a release agent as well as one or more external additives, wherein according to the X-ray photoelectron spectroscopy (abbreviated as XPS) quantification, the release agent exposed on surfaces of toner base particles accounts for 10% to 40%, and in the surfaces of the toner base particles, the external additive present on a release agent part accounts for 15% or less while the external additive present on the other parts than the release agent part accounts for 20% or more and 100% or less. According to JP-A 2008-20578, it is possible to obtain the electrostatic charge image developing toner which achieves a balance between its favorable powder flowability and its favorable fixing property causing no such troubles as hot offset.

However, in the toner contained in the electrostatic latent image developer disclosed by JP-A 9-319158, the amount of the wax exposed on the surface of the toner is too large to sufficiently curb the increase in the adherence of the toner to the carrier caused by the internal temperature rise of the developing tank, and it is therefore difficult to sufficiently prevent the flowability of the developer from deteriorating. Besides, the recent downsizing and speeding-up trend of image forming apparatus causes a further rise in the internal temperature of the developing tank, which leads to a more obvious decline in the flowability of the developer.

In the electrostatic charge image developing toner disclosed by JP-A 2008-20578, the external additive present on the release agent part in the surfaces of the toner base particles is defined, but the percentage of the release agent exposed on the surfaces of the toner base particles is too high to sufficiently curb the increase in the adherence of the toner to the carrier caused by the internal temperature rise of the developing tank, and it is therefore difficult to sufficiently prevent the flowability of the developer from deteriorating. Besides, the recent downsizing and speeding-up trend of image forming apparatus causes a further rise in the internal temperature of the developing tank, which leads to a more obvious decline in the flowability of the developer.

SUMMARY OF THE INVENTION

An object of the invention is to provide a toner which has curbed adherence to a charge applying material such as a carrier or a regulating blade to thereby prevent flowability of a developer from deteriorating and which is thus capable of forming a high-quality image with high resolution and high definition, as well as to provide a method of manufacturing the toner, a developer, a two-component developer, a developing device, and an image forming apparatus.

The invention provides a toner comprising at least a binder resin, a colorant, and a release agent, wherein an acid value of the release agent is less than 4.0 mgKOH/g, and an amount of the release agent exposed on a surface of the toner is 0.5% by weight or more and 2.5% by weight or less of a total amount of the toner.

According to the invention, the toner comprises at least the binder resin, the colorant, and the release agent which has an acid value of less than 4 mgKOH/g and is exposed on the surface of the toner in an amount of 0.5% by weight or more and 2.5% by weight or less of the total amount of the toner.

In the case where the acid value of the release agent is 4 mgKOH/g or more, the affinity of the release agent for the binder resin is high, so that the release agent is less easily eluted from the toner in being fixed, and high-temperature offset is more likely to occur as compared to the case where the acid value of the release agent is less than 4 mgKOH/g.

In the case where the amount of the release agent exposed on the surface of the toner is less than 0.5% by weight, the release agent eluted to the surface of the toner upon being fixed is not enough to prevent the offset, resulting in a fixing failure i.e. the high-temperature offset. In the case where the amount of the release agent exposed on the surface of the toner exceeds 2.5% by weight, an increase in an internal temperature of a developing tank enhances adherence of the toner contained in the developer to a charge applying material such as a carrier or a regulating blade, leading to a decrease in flowability of the developer as well as a decrease in charge amount of the toner, as compared to the case where the amount of the release agent exposed on the surface of the toner is 2.5% by weight or less.

Owing to the fact that the acid value of the release agent is set to be less than 4 mgKOH/g and that the amount of the release agent exposed on the surface of the toner is set to 0.5% by weight or more and 2.5% by weight or less of the total amount of the toner, the release agent can be easily eluted to the surface of the toner upon being fixed even when a content of the release agent in the surface of the toner is less than a conventional content of a release agent in a surface of toner, and in this case, it is also possible to curb the increase in the adherence of the toner to the charge applying material so that the flowability of the developer can be prevented from lowering, thus providing a resultant toner with a favorable fixing property and favorable charging stability. In forming images, the use of the toner as just stated enables stable formation of high-quality images with higher definition and higher resolution over a long period of time.

Further, in the invention, it is preferable that the release agent in the surface of the toner has a dispersion diameter of less than 300 nm.

According to the invention, the release agent in the surface of the toner has a dispersion diameter of less than 300 nm. Owing to the fact that the dispersion diameter of the release agent in the surface of the toner is set to be less than 300 nm, it is possible to decrease an area of contact between the release agent contained in the toner particles and a charge applying material and to further curb the increase in the adherence of the toner to the charge applying material caused by the internal temperature rise of the developing tank, so that the flowability of the developer can be further prevented from lowering, as compared to the case where the above dispersion diameter is 300 nm or more. Consequently, it is possible to further curb the decrease in the charge amount of the toner, resulting in the toner with higher charging stability as well as a favorable fixing property, which allows for stable formation of high-quality images with higher definition and higher resolution over a long period of time.

Further, in the invention, it is preferable that at least a part of the surface of the toner is covered.

According to the invention, at least a part of the surface of the toner is covered. The partial covering of the surface of the toner makes it possible to further decrease the area of contact between the release agent contained in the toner and a charge applying material and therefore to further curb the increase in the adherence of the toner to the charge applying material caused by the internal temperature rise of the developing tank, so that the flowability of the developer can be further prevented from lowering, as compared to the case where no surface of the toner is covered. Consequently, even when the release agent in the surface of the toner has a dispersion diameter of 300 nm or more, for example, it is possible to decrease the area of contact between the release agent and the charge applying material, resulting in the toner with higher charging stability as well as a favorable fixing property, which allows for stable formation of high-quality images with higher definition and higher resolution over a long period of time, just as in the case where the release agent in the surface of the toner has a dispersion diameter of less than 300 nm.

Further, in the invention, it is preferable that at least a part of the surface of the toner is encapsulated.

According to the invention, at least a part of the surface of the toner is encapsulated. The encapsulation, i.e. dense-coating, of part of the surface of the toner makes it possible to further decrease the area of contact between the release agent in the surface of the toner and a charge applying material and therefore to more reliably exert the effect of further curbing the increase in the adherence of the toner to the charge applying material caused by the internal temperature rise of the developing tank, to further prevent the flowability of the developer from lowering, as compared to the case where no surface of the toner is encapsulated. Consequently, even when the release agent in the surface of the toner has a dispersion diameter of 300 nm or more, it is possible to reliably decrease the area of contact between the release agent and the charge applying material, resulting in the toner with higher charging stability as well as a favorable fixing property, which allows for stable formation of high-quality images with higher definition and higher resolution over a long period of time, just as in the case where the release agent in the surface of the toner has a dispersion diameter of less than 300 nm.

Further, in the invention, it is preferable that the binder resin has an acid value of 5 mgKOH/g or more and 30 mgKOH/g or less.

According to the invention, the acid value of the binder resin is 5 mgKOH/g or more and 30 mgKOH/g or less. In the case where the acid value of the binder resin is less than 5 mgKOH/g, the affinity of the binder resin to the release agent is high, so that the release agent is less easily eluted to the surface of the toner upon being fixed, and high-temperature offset is more likely to occur as a fixing failure, as compared to the case where the acid vale of the binder resin is 5 mgKOH/g or more. In the case where the acid value of the binder resin exceeds 30 mgKOH/g as compared to the case where the acid value of the binder resin is 30 mgKOH/g or less, the toner has a larger amount of functional groups remaining in its surface and therefore are more likely to absorb moisture, which may cause a decrease in the charge amount of the toner under humid conditions to deteriorate the charging stability. And also, the dispersibility of the release agent in the binder resin is more likely to decrease, and if the toner was not kneaded sufficiently during its production process, the release agent in the surface of the toner may have a larger dispersion diameter. By adjusting the acid value of the binder resin to 5 mgKOH/g or more and 30 mgKOH/g or less, it is possible to provide the release agent in the toner particles with the dispersibility in a desired range; to be specific, the release agent in the surface of the toner can stably have a dispersion diameter of less than 300 nm, with the result that the decrease in the charge amount of the toner under humid conditions can be reduced to allow control on the affinity of the binder resin to the release agent so that a favorable fixing property is obtained. The toner can be thus provided with still more favorable charging stability and fixing property, resulting in capability of forming high-quality images having high definition and resolution even more stably over a long period of time.

Further, in the invention, it is preferable that the toner further comprises an external additive, which external additive covers 50% or more and less than 120% of surface area of the toner.

According to the invention, the toner further comprises the external additive, and the external additive covers 50% or more and less than 120% of a surface area of the toner. In the case where the coverage of the external additive is less than 50%, the surface of the toner will not be sufficiently covered with the external additive, which causes the toner and the charge applying material to come into contact with each other more frequently and thus increases the adherence of the toner to charge applying material, likely resulting in a decrease in the flowability of the developer, as compared to the case where the above coverage is 50% or more. In the case where the coverage of the external additive is 120% or more, a larger amount of the external additive is liberated from the toner and such an external additive; namely free external additive, will cause carrier contamination and therefore be likely to induce poor charging of the toner. When the external additive covers 50% or more and less than 120% of the surface area of the toner, no carrier contamination is caused and what is more, it is possible to curb the decrease in the flowability of the developer, resulting in the toner with still higher charging stability as well as a favorable fixing property, which allows for stable formation of high-quality images with higher definition and higher resolution over a long period of time.

The invention provides a method of manufacturing the toner, comprising:

a pulverizing step of pulverizing a resin composition containing at least a binder resin, a colorant, and a release agent into a first pulverized product and a second pulverized product having a greater volume average particle size than a volume average particle size of the first pulverized product;

a first classifying step of classifying the first pulverized product into a first toner particle group;

a second classifying step of classifying the second pulverized product into the second toner particle group having a greater volume average particle size than a volume average particle size of the first toner particle group;

a mixing step of mixing the first toner particle group and the second toner particle group; and a spheronizing step of spheronizing at least a part of the first pulverized product and the second pulverized product, the first toner particle group and the second toner particle group, and the mixed toner particle groups.

According to the invention, the method of manufacturing the toner of the invention includes: a pulverizing step of pulverizing a resin composition containing at least a binder resin, a colorant, and a release agent into the first pulverized product and the second pulverized product of which volume average particle size is greater than a volume average particle size of the first pulverized product; the first classifying step of classifying the first pulverized product into the first toner particle group; the second classifying step of classifying the second pulverized product into the second toner particle group of which volume average particle size is greater than a volume average particle size of the first toner particle group; a mixing step of mixing the first toner particle group and the second toner particle group; and a spheronizing step of spheronizing at least a part of the first pulverized product and the second pulverized product, the first toner particle group and the second toner particle group, and the mixed toner particle groups. By spheronizing at least a part of the first pulverized product and the second pulverized product, the first toner particle group and the second toner particle group, and the mixed toner particle groups, it is possible to decrease an area of contact of the toner with an image bearing member and an intermediate transfer medium and to decrease the adherence of the toner to the image bearing member and the intermediate transfer belt, so that the toner can be smoothly transferred from the image bearing member and the intermediate transfer medium to a recording medium, thus allowing for higher transfer efficiency of the toner, as compared to the case where no spheronizing process is carried out. Moreover, in the fixing step with toner deposited on the recording medium, the surfaces of the toner particles are less corrugated and the toner particles have smaller space therebetween, thus allowing for the toner to have excellent toner particle-to-particle thermal conductivity and a favorable low-fixing property, as compared to the case where no spheronizing process is carried out. In addition, the controllability on the irregularities of the surfaces of the toner particles means that the charge distribution of the surfaces of the toner particles can be made homogeneous. It is therefore possible to reduce image-missing parts or image roughness even in the case of using such a rough-surfaced recording medium that has more difficulty in forming high-quality images thereon than smooth-surfaced recording mediums, thus providing a toner which is capable of stably forming high-quality images with high definition and high resolution over a long period of time.

Further, in the invention, it is preferable that in the spheronizing step, neither the first pulverized product nor the first toner particle group is processed while at least either the second pulverized product or the second toner particle group is processed.

According to the invention, the first pulverized product and the first toner particle group are not subjected to the spheronizing process while at least either the second pulverized product or the second toner particle group is subjected to the spheronizing process. In general, as the toner particles have smaller sizes, it is harder to remove by a cleaning blade the toner which has failed to be transferred and remains on the image bearing member, leading to a decreased cleaning property. This tendency that the cleaning property is decreased with smaller toner particles, becomes more prominent as the toner particles have less corrugated surfaces owing to the spheronization. Moreover, as larger toner particles have more corrugated surfaces, the toner particle-to-particle physical adherence will more easily lose its balance with respect to the image bearing member. In the case of treating neither the first pulverized product nor the first toner particle group but at least either the second pulverized product or the second toner particle group with the spheronizing process, the toner particles having a small volume average particle size can be provided with more corrugated surfaces while the toner particles having a large volume average particles size can be provided with less corrugated surfaces, resulting in toner particles as a whole with a favorable cleaning property. Consequently, it is possible to provide a toner which causes no fog and is capable of stably forming high-quality images with high definition and high resolution over a long period of time.

Further, in the invention, it is preferable that a weight ratio of the second toner particle group mixed in the mixing step is 5 parts by weight or more and 120 parts by weight or less to 100 parts by weight of the first toner particle group.

According to the invention, in the mixing step, the first toner particle group and the second toner particle group are mixed in the weight ratio of 100 parts by weight to 5 parts by weight or more and 120 parts by weight or less. If the second toner particle group is mixed in the weight ratio of less than 5 parts by weight to 100 parts by weight of the first toner particle group, the area of contact of the resultant toner with an image bearing member and an intermediate transfer medium will be wider, leading to a lower transfer efficiency of the toner, and therefore images formed with the toner on rough-surface recording mediums will have image-missing parts, which means lower image reproducibility, as compared to the case where the weight ratio of the mixed second toner particle group is 5 parts by weight or more. Moreover, in the fixing step, the toner particles have wider space therebetween and may therefore form a toner image having too low thermal conductivity to obtain a favorable low-temperature fixing property. Furthermore, the toner particles are not controlled to avoid corrugated surfaces, resulting in an increase in an amount of the first toner particle group of which particles tend to have surface charge distribution difficult to be homogenized, and the toner will therefore spatter more easily. In addition, the increase in the content of the toner particles having a small volume average particle size may cause the resultant toner to have lower flowability. If the second toner particle group is mixed in the weight ratio of 120 parts by weight to 100 parts by weight of the first toner particle group, a content of the toner particles having a large volume average particle size is so higher that it becomes difficult to form high-definition images, resulting in lower image reproducibility.

When the first toner particle group and the second toner particle group are mixed in the weight ratio of 100 parts by weight to 5 parts by weight or more and 120 parts by weight or less, the toner having a small volume average particle size allows for formation of high-definition images, and the toner will spatter less frequently, thereby allowing for curbed deterioration of images, as well as be provided with a favorable low-temperature fixing property and excellent flowability, resulting in a toner which is capable of stably forming high-quality images with high definition and high resolution over a long period of time.

Further, in the invention, it is preferable that a weight ratio of the second toner particle group mixed in the mixing step is 5 parts by weight or more and 70 parts by weight or less to 100 parts by weight of the first toner particle group.

According to the invention, in the mixing step, the first toner particle group and the second toner particle group are mixed in the weight ratio of 100 parts by weight to 5 parts by weight or more and 70 parts by weight or less. When the second toner particle group is mixed in the weight ratio of 70 parts by weight or less to 100 parts by weight of the first toner particle group, a content of the toner particles having a large volume average particle size is adjusted to a more appropriate level, which makes such an effect more notable that high-definition images can be formed with high reproducibility over a long period of time, as compared to the case where the second toner particle group is mixed in the weight ratio of 5 parts by weight or more and 120 parts by weight or less to 100 parts by weight of the first toner particle group.

The invention provides a developer comprising the toner mentioned above.

According to the invention, the developer contains the toner of the invention. This enables the developer to be provided with a favorable fixing property and favorable charging stability as well as other properties stable with long-term use, thus resulting in the developer which is capable of maintaining a favorable developing property.

Further, the invention provides a two-component developer comprising the toner mentioned above and a carrier.

According to the invention, the developer is a two-component developer composed of the toner of the invention and a carrier. The toner of the invention has excellent preservation stability and therefore curbs the decrease in flowability of the developer, thereby providing the two-component developer having favorable charging stability and developing property. The use of such a two-component developer eliminates toner spattering and allows for stable formation of high-quality images with high definition and high resolution over a long period of time.

Further, in the invention, it is preferable that the carrier has a volume average particle size of 30 μm or more and 50 μm or less.

According to the invention, the carrier in the two-component developer has a volume average particle size of 30 μm or more and 50 μm or less. If the volume average particle size of the carrier is less than 10 μm, magnetic force acting between the carrier and the developing roller is weaker, which makes it easier to cause the toner to be developed with the toner in the developing step, as compared to the case where the volume average particle size of the carrier is 10 μm or more. If the volume average particle size of the carrier exceeds 100 μm, each toner particle may not be sufficiently charged. When the carrier has a volume average particle size of 10 μm or more and 100 μm or less, the toner and the carrier are able to come into contact with each other more frequently, so that charge on each toner particle can be controlled to provide a toner with sufficient chargeability, as compared to the case where the volume average particle size of the carrier exceeds 100 μm. It is therefore possible to obtain a two-component developer having a favorable toner developing property. The above-mentioned effects can be exerted more stably with the carrier having a volume average particle size of 30 μm or more and 50 μm or less.

The invention provides a developing device which develops latent images formed on an image bearing member into toner images with use of the developer mentioned above.

According to the invention, the developing device develops latent images with the developer of the invention and therefore is capable of stably forming on an image bearing member toner images having high definition and high resolution. Consequently, it is possible to stable form high-quality images.

The invention provides an image forming apparatus comprising:

an image bearing member;

a latent image forming section for forming a latent image on the image bearing member; and the developing device mentioned above.

According to the invention, an image forming-apparatus comprises an image bearing member on which a latent image is formed; a latent image forming section forming the latent image on the image bearing member; and the developing device of the invention-being capable of forming on the image bearing member toner images having high definition and high resolution. By forming images through such an image forming apparatus, it is possible to stably form images with high definition and high resolution.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
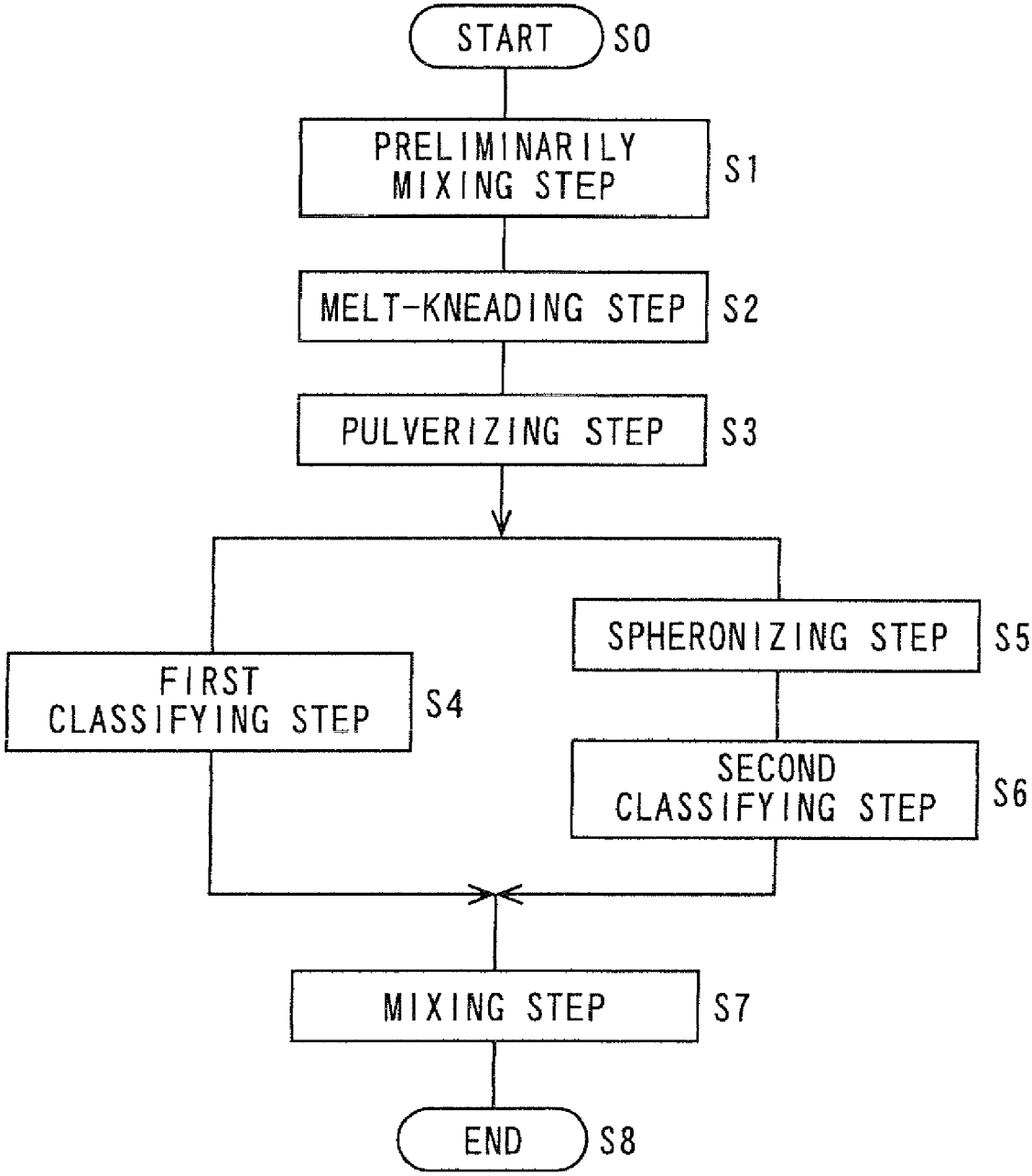
FIG. 1 is a flowchart showing one example of a method of manufacturing a toner according to one embodiment of the invention.

Now referring to the drawings, preferred embodiments of the invention are described below.

1. Toner

A toner according to the first embodiment of the invention contains at least a binder resin, a colorant, and a release agent. The release agent has an acid value less than 4 mgKOH/g, and an amount of the release agent exposed on a surface of toner is 0.5% by weight or more and 2.5% by weight or less of a total mount of the toner.

[Binder Resin]

The binder resin is not particularly limited, and the binder resin for black toner or color toner may be used. Examples of the binder resin include: a polyester resin; a styrene resin such as polystyrene or styrene-acrylic ester copolymer resin; an acrylic resin such as polymethylmethacrylate; a polyolefin resin such as polyethylene; polyurethane; and an epoxy resin. Also usable is a resin obtained by polymerization reaction of an ingredient monomer mixture and the release agent which are mixed with each other, and in this case, it is preferred that the polyester resin be contained. When the polyester resin is contained in the binder resin, the release agent will have enhanced controllability on its dispersed state, resulting in a toner that has a still more excellent fixing property. And in this case, the toner can be provided with excellent durability and transparency. The binder resin may be used each alone, or two or more thereof may be used in combination.

For the polyester resin, a heretofore known polyester resin can be used without particular limitation, including polycondensation of polybasic acids and polyvalent alcohols, for example. The polybasic acids include polybasic acid as well as a derivative of polybasic acid such as acid anhydride or esterified compound of polybasic acid. The polyvalent alcohols indicate a compound containing two or more hydroxyl groups and include both of alcohols and phenols.

For the polybasic acids, those commonly used as monomers of the polyester resin may be used including, for example, aromatic carboxylic acids such as terephthalic acid, isophthalic acid, phthalic anhydride, trimellitic anhydride, pyromellitic acid, and naphthalene dicarboxylic acid; and aliphatic carboxylic acids such as maleic anhydride, fumaric acid, succinic acid, and adipic acid. The polybasic acids may be used each alone, or two or more thereof may be used in combination.

For the polyvalent alcohol, those commonly used as monomers of the polyester resin can also be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. Herein, "bisphenol A" indicates 2,2-bis(p-hydroxyphenyl)propane. Examples of the ethylene oxide adduct of bisphenol A include polyoxyethylene-2,2-bis(4-hydroxyphenyl)propane. Examples of the propylene oxide adduct of bisphenol A include polyoxypropylene-2,2-bis(4-hydroxyphenyl)propane. The polyalcohols may be used each alone, or two or more thereof may be used in combination.

The polyester resin may be produced by synthesis in the polycondensation reaction. The synthesis can be achieved by, for example, the polycondensation reaction, specifically, dehydration-condensation reaction, of polybasic acids and polyalcohols in the presence of a catalyst in an organic or inorganic solvent. In this case, a part of the polybasic acids may be subjected to the de-methanol polycondensation reaction by using a methyl-esterified compound of polybasic acid. The polycondensation reaction of polybasic acids and polyalcohols may be terminated at the instant when the acid value and softening temperature of the resultant polyester stand at predetermined values. In the polycondensation reaction, by properly changing the blending ratio, reaction rate, or other conditions for the reaction, of the polybasic acids and the polyhydric alcohols, it is possible to adjust, for example, the terminal carboxyl group content of the resultant polyester resin and further to adjust the acid value, softening temperature, and other properties of the resultant polyester.

In the present embodiment, an acid value of the binder resin is preferably 5 mgKOH/g or more and 30 mgKOH/g or less. In the case where the acid value of the binder resin is less than 5 mgKOH/g, the affinity of the binder resin to the release agent is high, so that the release agent is less easily eluted to the surface of the toner upon being fixed, and high-temperature offset is more likely to occur as a fixing failure, as compared to the case where the acid vale of the binder resin is 5 mgKOH/g or more. In the case where the acid value of the binder resin exceeds 30 mgKOH/g as compared to the case where the acid value of the binder resin is less than 30 mgKOH/g, the toner have a larger amount of functional groups remaining in its surface and therefore are more likely to absorb moisture, which may cause a decrease in the charge amount of the toner under humid conditions to deteriorate the charging stability. And also, the dispersibility of the release agent in the binder resin is more likely to decrease, and if the toner was not kneaded sufficiently during its production process, the release agent in the surface of the toner may have a larger dispersion diameter. By adjusting the acid value of the binder resin to 5 mgKOH/g or more and 30 mgKOH/g or less, it is possible to provide the release agent in the toner with the dispersibility in a desired range; to be specific, the release agent in the surface of the toner can stably have a dispersion diameter of less than 300 nm, with the result that the decrease in the charge amount of the toner under humid conditions can be reduced to allow control on the affinity of the binder resin to the release agent so that a favorable fixing property is obtained. The toner can be thus provided with still more favorable charging stability and fixing property, resulting in capability of forming high-quality images having high definition and resolution even more stably over a long period of time.

The acid value of the binder resin can be adjusted as follows. In the synthesis of the binder resin, the blending ratio, reaction rate, or other conditions for the reaction, of a mixture of raw material monomers for the binder resin; that is, in the case of the polyester resin, for example, the polybasic acids and the polyhydric alcohols, is changed properly to thereby adjust a terminal carboxyl group content of the resultant binder resin, which can lead to the adjustment of the acid value of the resultant binder resin.

[Colorant]

The colorant includes, for example, yellow toner colorant, magenta toner colorant, cyan toner colorant, and black toner colorant.

The yellow toner colorant includes, for example, organic pigments such as C.I. pigment yellow 1, C.I. pigment yellow 5, C.I. pigment yellow 12, C.I. pigment yellow 15, C.I. pigment yellow 17, C.I. pigment yellow 74, C.I. pigment-yellow 93, C.I. pigment yellow 180, and C.I. pigment yellow 185; inorganic pigments such as yellow iron oxide and yellow ocher; nitro dye such as C.I. acid yellow 1; and oil-soluble dye such as C.I. solvent yellow 2, C.I. solvent yellow 6, C.I. solvent yellow 14, C.I. solvent yellow 15, C.I. solvent yellow 19, and C.I. solvent yellow 21, which are all classified according to color index.

The magenta toner colorant includes, for example, C.I. pigment red 49, C.I. pigment red 57, C.I. pigment red 81, C.I. pigment red 122, C.I. solvent red 19, C.I. solvent red 49, C.I. solvent red 52, C.I. basic red 10, and C.I. disperse red 15, which are all classified according to color index.

The cyan toner colorant includes, for example, C.I. pigment blue 15, C.I. pigment blue 16, C.I. solvent blue 55, C.I. solvent blue 70, C.I. direct blue 25, and C.I. direct blue 86.

The black toner colorant includes, for example, carbon black such as channel black, roller black, disk black, gas furnace black, oil furnace black, thermal black, and acetylene black. Among these carbon black, suitable carbon black may be appropriately selected according to design characteristics of the toner to be obtained.

Other than these pigments, a red pigment, a green pigment, and the like may be used. The colorant may be used each alone, and two or more thereof may be used in combination. Further, two or more of the colorants of the same color series may be used together, and one or two or more colorants respectively selected from different color series may also be used together.

The colorant is preferably used in form of a master batch. The master batch of the colorant can be manufactured, for example, by kneading a molten product of synthetic resin and the colorant. For the synthetic resin, a resin is used of the same sort as that of the binder resin of the toner, or used is a resin highly compatible with the binder resin of the toner. A usage ratio of the synthetic resin and the colorant is not particularly limited, and it is preferable that the colorant constitutes 30 parts by weight or more and 100 parts by weight or less based on 100 parts of the synthetic resin. The master batch is used, for example, with granulated particles around 2 mm or more and 3 mm or less in size.

In the present embodiment, a content of the colorant is not particularly limited, and is preferably 4 parts by weight or more and 20 parts by weight or less based on 100 parts by weight of the binder resin. In the case of using the master batch, a usage of the master batch is preferably adjusted so that a content of the colorant in the toner of the invention falls in the above range. When the usage of the colorant falls in the above range, it is possible to form a favorable image having excellent image quality with sufficient image density and high color appearance.

[Release Agent]

The release agent is not particularly limited, and heretofore known agent may be used including, for example: petroleum-based wax such as paraffin wax and derivatives thereof, and microcrystalline wax and derivatives thereof; hydrocarbon-based synthetic wax such as Fischer-Tropsch wax and derivatives thereof, polyolefin wax and derivatives thereof, low-molecular-weight polypropylene wax and derivatives thereof, and polyolefinic polymer wax and derivatives thereof; carnauba wax and derivatives thereof; and ester wax.

As described above, the acid value of the release agent is less than 4 mgKOH/g and the amount of the release agent exposed on the surface of the toner is 0.5% by weight or more and 2.5% by weight or less of the total amount of the toner in the above embodiment. It is more preferable that the amount of the release agent exposed on the surface of the toner is 0.7% by weight or more and 1.8% by weight or less of the total amount of the toner.

In the case where the acid value of the release agent is 4 mgKOH/g or more, the affinity of the release agent to the binder resin is high, so that the release agent is less easily eluted from the toner upon being fixed, and high-temperature offset is more likely to occur, as compared to the case where the acid vale of the release agent is less than 4 mgKOH/g.

In the case where the amount of the release agent exposed on the surface of the toner is less than 0.5% by weight, the release agent eluted to the surface of the toner upon being fixed is not enough to prevent the offset, resulting in a fixing failure i.e. the high-temperature offset. In the case where the amount of the release agent exposed on the surface of the toner exceeds 2.5% by weight, an increase in an internal temperature of a developing tank enhances adherence of the toner contained in the developer to a charge applying material such as a carrier or a regulating blade, leading to a decrease in flowability of the developer as well as a decrease in the charge amount of the toner, as compared to the case where the amount of the release agent exposed on the surface of the toner is 2.5% by weight or less.

Owing to the fact that the acid value of the release agent is set to be less than 4 mgKOH/g and that the amount of the release agent exposed on the surface of the toner is set to 0.5% by weight or more and 2.5% by weight or less of the total amount of the toner, the release agent can be easily eluted to the surface of the toner upon being fixed even when a content of the release agent in the surface of the toner is less than a conventional content of a release agent in surface of toner, and in this case, it is also possible to curb the increase in the adherence of the toner to the charge applying material so that the flowability of the developer can be prevented from lowering, thus providing a resultant toner with a favorable fixing property and favorable charging stability. In forming images, the use of the toner as just stated enables stable formation of high-quality images with higher definition and higher resolution over a long period of time.

In the embodiment, the amount of the release agent exposed on the surface of the toner represents a ratio to the total amount of the toner, of a content of the release agent present in a surface layer region ranging to a depth of 500 nm or less from the surface of the toner.

In the embodiment, the amount of the release agent exposed on the surface of the toner is estimated from a difference of heat capacity between a toner which has been treated with the elusion process that liquates the release agent in the surface of the toner out with such a solvent that only a release agent is dissolvable (readily-soluble), and a toner which has not been treated with the elusion process. Heat capacity of a toner; that is, the content of the release agent in the toner, is measured by using a differential scanning calorimeter: DSC220 (trade name) manufactured by Seiko Instruments & Electronics Ltd. Specifically, as to the method of measurement, 1 g of a sample toner is heated from 20° C. to 150° C. at a temperature increase rate of 10° C./min, following rapid cooling from 150° C. to 20° C., a sequence of which operation is repeated twice, thus forming a DSC curve. The content of the release agent in the toner is calculated based on melting heat quantity of the DSC curve measured at the second operation.

In the embodiment, the release agent in the surface of the toner preferably has a dispersion diameter of less than 300 nm. Owing to the fact that the dispersion diameter of the release agent in the surface of the toner is set to be less than 300 nm, it is possible to decrease an area of contact between the release agent contained in the toner particles and a charge applying material and to further curb the increase in the adherence of the toner to the charge applying material caused by the internal temperature rise of the developing tank, so that the flowability of the developer can be further prevented from lowering, as compared to the case where the above dispersion diameter is 300 nm or more. Consequently, it is possible to further curb the decrease in the charge amount of the toner, resulting in the toner with higher charging stability as well as a favorable fixing property, which allows for stable formation of high-quality images with higher definition and higher resolution over a long period of time.

The dispersion diameter of the release agent in the toner surface is determined through image analysis on a micrograph of the toner particles obtained by removing the release agent exposed on the surface of the toner through elution into an organic solvent.

[Charge Control Agent]

The toner of the present embodiment preferably contains other toner additive components represented by a charge control agent, with the binder resin, the colorant, and the release agent. The addition of the charge control agent gives the toner a favorable charging property. The usable charge control agent includes a positive charge control agent and a negative charge control agent.

The positive charge control agent includes, for example, a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The negative charge control agent includes oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a boron compound, a fatty acid soap, long-chain alkylcarboxylic acid salt, and a resin acid soap. The charge control agents may be used each alone, or two or more thereof may be used in combination.

A usage of the compatible charge control agent is preferably 0.5 part by weight or more and 5 parts by weight or less based on 100 parts by weight of the binder resin, and more preferably 0.5 part by weight or more and 3 parts by weight or less based on 100 parts by weight of the binder resin. When the content of the charge control agent is larger than 5 parts by weight, a carrier is contaminated, causing the toner to spatter. When the content of the non-compatible charge control agent is less than 0.5 part by weight, the toner is not given a sufficient charging property.

[Toner]

In the present embodiment, it is preferable that a volume average particle size of the toner is 5.0 μm or more and 7.0 μm or less, and a content of the toner having a number average particle size of 5.0 μm or less is less than 40% by number. The toner satisfying the above particle size distribution and particle number distribution is less likely to spatter and therefore capable of forming high-quality images with high definition and high resolution. A toner having a volume average particle size of less than 5.0 μm has lower flowability and therefore spatters, while a toner having a volume average particle size over 7.0 μm is not capable of forming images with sufficiently high definition and resolution. When the content of the toner particles having a number average particle size of 5.0 μm or less is 40% by number or more of the entire toner particles, the toner will spatter due to a decrease in flowability and cause fog due to lessened transfer efficiency.

In the embodiment, the volume average particle size ($D_{50v}$) and the content (% by volume, % by number) of the toner particles having a number average particle size of 5.0 μm or less are measured by a particle size distribution-measuring device: MULTISIZER III (trade name) manufactured by Beckman Coulter, Inc. Measurement conditions are as follows.

Aperture diameter: 100 μm

Number of measured particles: 50,000 counts

Analysis software: COULTER MULTISIZER ACCUCOMP 1.19 version (manufactured by Beckman Coulter, Inc.)

Electrolyte: ISOTON II (manufactured by Beckman Coulter, Inc.)

Dispersant: sodium alkylether sulfate

Procedure for the measurement is as follows. In a beaker, 50 ml of the electrolyte, 20 mg of the toner sample, and 1 ml of the dispersant are put and then treated with a three-minute dispersion process in an ultrasonic disperser, thereby preparing a measurement sample of which particle size is measured by the above measurement device MULTISIZER III. From a measurement result thus obtained, volume particle size distribution and number particle size distribution of the sample particles are determined. From the volume particle size distribution, the volume average particle size ($D_{50v}$) is determined, and from the number particle size distribution, the content (% by number) of the fine toner particles having a number average particle size of 5.0 μm or less is determined.

In the present embodiment, the toner particles preferably have an average degree of circularity (a) of 0.950 or more and 0.960 or less. By setting the average degree of circularity of the toner particles to fall in that range, the toner particles are provided with a proper degree of circularity to reduce occurrence of fog with the cleaning property maintained, thus allowing for formation of high-quality images.

In the embodiment, the degree of circularity (ai) of the toner particles is defined by the following expression (1). The degree of circularity (ai) of the toner particles as defined by the expression (1) can be determined, for example, by using a flow particle image analyzer: FPIA-3000 manufactured by Sysmex Corporation. A sum of respective degrees of circularity (ai) of "m" pieces of toner particles is obtained first, and the sum is then divided by the number of the toner particles, i.e., the number "m", as in the following expression (2). An arithmetic mean value thus obtained is defined as the average degree of circularity (a).

$$\text{Degree of circularity } (ai) = (\text{Peripheral length of circle having the same projection area as that of particle image})/(\text{Length of circumference of projection image of particles}) \quad (1)$$

$$\text{Average degree of circularity } (a) = \sum_{i=1}^{m} ai/m \quad (2)$$

In the above measurement device "FPIA-3000", a simple calculation method is used that the degrees of circularity (ai) of the respective toner particles are determined; thus-obtained degrees 0.40 to 1.00 in circularity (ai) of the respective toner particles are divided into 61 divisions for every 0.01; frequencies for the respective divisions are obtained; and medians and the frequencies for respective divisions are used to determine the average degree of circularity. Since a value of the average degree of circularity thus obtained by the simple calculation method is not so different from a value of the average degree of circularity (a) obtained by the above expression (2) that a difference therebetween can be substantially overlooked, the average degree of circularity obtained by the simple calculation method is regarded as the average degree of circularity (a) defined by the expression (2) in the present embodiment.

A specific method of measuring the average degree of circularity (ai) is as follows.

Dispersion is prepared by dispersing 5 mg of the toner in 10 ml of water having about 0.1 g of surfactant dissolved therein. The dispersion is then irradiated for five minutes with ultrasonic wave which is 20 kHz in frequency and 50 W in outputs, to thereby prepare dispersion of which toner particle concentration is 50,000 pieces/μL to 20,000 pieces/μL. The dispersion containing toner particles is then poured into a very thin, flat cell in the above device "FPIA-3000" and irradiated with flashes of light to be photographed by a charge coupled device (CCD) camera, which enables measurement of particle size, shape, etc. to determine the degrees of circularity (ai).

In the embodiment, it is preferable that at least a part of the surface of the toner is covered. The partial covering of the surface of the toner makes it possible to further decrease the area of contact between the release agent in the surface of the toner and a charge applying material and therefore to further curb the increase in the adherence of the toner to the charge applying material caused by the internal temperature rise of the developing tank, so that the flowability of the developer can be further prevented from lowering, as compared to the case where no surface of the toner is covered. Consequently, even when the release agent in the surface of the toner has a dispersion diameter of 300 nm or more, for example, it is possible to decrease the area of contact between the release agent and the charge applying material, resulting in the toner with higher charging stability as well as a favorable fixing property, which allows for stable formation of high-quality images with higher definition and higher resolution over a long-period of time, just as in the case where the release agent in the surface of the toner has a dispersion diameter of less than 300 nm.

In the embodiment, it is preferable that at least a part of the surface of the toner is encapsulated. The encapsulation, i.e. dense-coating, of a part of the surface of the toner makes it possible to further decrease the area of contact between the release agent in the surface of the toner and a charge applying material and therefore to more reliably exert the effect of further curbing the increase in the adherence of the toner to the charge applying material caused by the internal temperature rise of the developing tank, to further prevent the flowability of the developer from lowering, as compared to the case where no surface of toner is encapsulated. Consequently, even when the release agent in the surface of the toner has a dispersion diameter of 300 nm or more, it is possible to reliably decrease the area of contact between the release agent and the charge applying material, resulting in the toner with higher charging stability as well as a favorable fixing property, which allows for stable formation of high-quality images with higher definition and higher resolution over a long period of time, just as in the case where the release agent in the surface of the toner has a dispersion diameter of less than 300 nm.

[External Additive]

The toner of the invention may be mixed with an external additive having functions such as enhancing powder flowability, enhancing frictional chargeability, enhancing heat resistance, improving long-term preservation stability, improving a cleaning property, and controlling a wear characteristic of photoreceptor surface. Examples of the external additive include fine silica powder, fine titanium oxide powder, and fine aluminum powder. The external additive may be used each alone, or two or more thereof may be used in combination.

In the present embodiment, the external additive preferably covers 50% or more and less than 20% of the surface area of the toner. In the case where the coverage of the external additive is less than 50%, the surfaces of the toner will not be sufficiently covered with the external additive, which causes the toner and the charge applying material to come into contact with each other more frequently and thus increases the adherence of the toner to charge applying material, likely resulting in a decrease in the flowability of the developer, as compared to the case where the above coverage is 50% or more. In the case where the coverage of the external additive is 120% or more, a larger amount of the external additive is liberated from the toner and such an external additive; namely free external additive, will cause carrier contamination and therefore be likely to induce poor charging of the toner. When the external additive covers 50% or more and less than 120% of the surface area of the toner, no carrier contamination is caused and what is more, it is possible to curb the decrease in the flowability of the developer, resulting in the toner with still higher charging stability as well as a favorable fixing property, which allows for stable formation of high-quality images with higher definition and higher resolution over a long period of time.

The coverage of the external additive over the surface of the toner represents a ratio of the surface area of the external additive present in the surfaces of the toner to the surface area of the toner containing no external additive (which toner may be hereinafter referred to "toner base particle") The coverage of the external additive can be determined by assigning to the following expression (3) a volume average particle size and absolute specific gravity of the toner base particles which have not yet mixed with the external additive; an average primary particle size and absolute specific gravity of the external additive; and a ratio of a weight of the external additive to a weight of the toner base particles (the weight of the external additive/the weight of the toner base particles).

$$f\ (\%) = \frac{\sqrt{3} \cdot D \cdot \rho t \cdot C}{2\pi \cdot d \cdot \rho i} \times 100 \tag{3}$$

where f represents the coverage of the external additive; D represents the volume average particle size (μm) of the toner base particles; d represents the average primary particle size (μm) of the external additive; pt represents the absolute specific gravity of the toner base particles; ρi represents the absolute specific gravity of the external additive; and C represents the ratio of the weight of the external additive to the weight of the toner base particles (the weight of the external additive/the weight of the toner base particles).

An amount of the external additive to be added is preferably 0.1 part by weight or more and 10 parts by weight or less, more preferably 2.0 parts by weight or more and less than 4.0 parts by weight, based on 100 parts by weight of the toner particles in view of charge quantity required for the toner, influence on photoreceptor wear through addition of the external additive, environmental characteristics of the toner, and the like elements. When the toner particle contains the external additive of 2.0 parts by weight or more and less than 4.0 parts by weight, the toner can be given more favorable flowability and the charge on each toner particle can be controlled properly, thus allowing for formation of a high-quality image having the fixing property not impaired and not suffering from the fog. When the content of the external additive is less than 2.0 parts by weight, the toner (especially small-size toner) is not given sufficient flowability, resulting in insufficient charging of each toner particle, which easily causes the fog on the non-image part. When a content of the external additive is 4.0 parts by weight or more, particles of the external additive will aggregate more easily and therefore be not able to efficiently cover the surface of the toner, thus failing to increase the flowability, with the result that each toner particle will not be sufficiently charged and fog is likely to appear on the non-image part.

2. Method of Manufacturing Toner

A method of manufacturing a toner according to one embodiment of the invention includes: a pulverizing step of pulverizing a resin composition containing at least a binder resin, a colorant, and a release agent into the first pulverized product and the second pulverized product of which volume average particle size is greater than a volume average particle size of the first pulverized product; the first classifying step of classifying the first pulverized product into the first toner particle group; the second classifying step of classifying the second pulverized product into the second toner particle group of which volume average particle size is greater than a volume average particle size of the first toner particle group; and a mixing step of mixing the first toner particle group and the second toner particle group.

In the present embodiment, it is preferable to spheronize at least a part of the first pulverized product and the second pulverized product, the first toner particle group and the second toner particle group, and the mixed toner particle groups. By spheronizing at least a part of the first pulverized product and the second pulverized product, the first toner particle group and the second toner particle group, and the mixed toner particle groups, it is possible to decrease an area of contact of the toner with an image bearing member and an intermediate transfer medium and to decrease the adherence of the toner to the image bearing member and the intermediate transfer belt, so that the toner can be smoothly transferred from the image bearing member and the intermediate transfer medium to a recording medium, thus allowing for higher transfer efficiency of the toner, as compared to the case where no spheronizing process is carried out. Moreover, in the fixing step with toner deposited on the recording medium, the surfaces of the toner particles are less corrugated and the toner particles have smaller space therebetween, thus allowing for the toner to have excellent toner particle-to-particle thermal conductivity and a favorable low-fixing property, as compared to the case where no spheronizing process is carried out. In addition, the controllability on the irregularities of the surfaces of the toner particles means that the charge distribution of the surfaces of the toner particles can be made homogeneous. It is therefore possible to reduce image-missing parts or image roughness even in the case of using such a rough-surfaced recording medium that has more difficulty in forming high-quality images thereon than smooth-surfaced recording mediums, thus providing a toner which is capable of stably forming high-quality images with high definition and high resolution over a long period of time.

FIG. 1 is a flowchart showing one example of a method of manufacturing a toner according to one embodiment of the invention. The method of manufacturing a toner according to the present embodiment includes: a preliminarily mixing step (Step S1) of mixing at least a binder resin, a colorant, and a release agent into an admixture; a melt-kneading step (Step S2) of melt-kneading the admixture into a melt-kneaded product which is a resin composition; a pulverizing step (Step S3) of pulverizing the melt-kneaded product into the first pulverized product and the second pulverized product having a greater volume average particle size than that of the first pulverized product; the first classifying step (Step S4) of classifying the first pulverized product into the first toner particle group; a spheronizing step (Step S5) of spheronizing the second pulverized product; the second classifying step (Step S6) of classifying the spheronized product resulting from the second pulverized product, into the second toner particle group having a greater volume average particle size than that of the first toner particle group; and a mixing step (Step S7) of mixing the first toner particle group and the second toner particle group.

The respective manufacturing processes of Step S1 to Step S7 will be explained in detail below. Note that the manufacturing process of Step S4 for preparing the first toner particle group and the manufacturing process of Step S5 and Step S6 for preparing the second toner particle group may be conducted at the same time, or one of the manufacturing processes may be conducted earlier than the other. The shift from Step S0 to Step S1 initiates the manufacture of the toner in the present embodiment.

[Preliminarily Mixing Step]

In the preliminary mixing step S1, at least a binder resin, a colorant, and a release agent are dry-mixed with each other by a mixer into an admixture. In the toner, other toner additive components may be contained with the binder resin, the colorant, and the release agent. The other toner additive components include a charge control agent. For theses components, ingredients and usage thereof are not particularly limited, and known substances may be used in a commonly-applied amount.

For the mixer used for dry-mixing, a known mixer can be used including, for example, a Henschel-type mixing device such as FMMIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron-Corporation, HYBRIDIZATION SYSTEM (trade name) manufactured by Nara Machinery Co., Ltd., and COSMOSYSTEM (trade name) manufactured by Kawasaki Heavy Industries, Ltd.

In the embodiment, it is necessary to control an amount of the release agent to be added in the preliminarily mixing step in order to adjust an amount of the release agent exposed on the surfaces of the toner particles. To be specific, for 0.5% by weight or more and 2.5% by weight or less of the release agent to be exposed on the surfaces of the toner particles, the amount of the release agent to be added in the preliminarily mixing step is set at 2.5 parts by weight or more and 6.0 parts by weight or less based on 100 parts by weight of the binder resin.

[Melt-Kneading Step]

In the melt-kneading step S2, the admixture prepared in the preliminary mixing step is melt-kneaded into a melt-kneaded product. In melt-kneading the admixture, the admixture is heated to a temperature equal to or higher than the softening temperature of the binder resin and lower than the decomposition temperature of the binder resin to thereby melt or soften the binder resin in which the toner ingredients other than the binder resin will be then dispersed.

For the kneading device, a known device can be used including, for example, a twin-screw extruder, a three roll mill, and a laboplast mill. Specific examples of such a kneading device include single or twin screw extruders such as TEM-100B (trade name) manufactured by Toshiba Machine Co., Ltd., and PCM-65/87 and PCM-30, both of which are trade names and manufactured by Ikegai, Ltd., and open roll-type kneading machines such as KNEADEX (trade name) manufactured by Mitsui Mining Co., Ltd. Among these kneaders, the open roll-type kneading machines are preferred. The admixture of the toner ingredients may be melt-kneaded by using a plurality of the kneading devices.

A dispersion diameter of each particle of the release agent on the surfaces of the toner particles can be controlled to fall in a proper range, specifically, to be less than 300 nm, through proper adjustment of an agitation rate, kneading duration, etc. in the kneading process.

[Pulverizing Step]

In the pulverizing step S3, the melt-kneaded product obtained in the melt-kneading step is cooled to be solidified and such a cool, solidified product is then pulverized into the first pulverized product and the second pulverized product of which particles have a greater volume average particle size of that of the first pulverized product.

The melt-kneaded product cooled and solidified is firstly pulverized by a hammer mill, a cutting mill, or the like device, into a coarsely pulverized product having a volume average particle size of around 100 μm or more and 5 mm or less, for example. After that, the coarsely pulverized product thus obtained is finely pulverized into the first pulverized product having a desired volume average particle size and the second pulverized product having a desired volume average particle size.

For finely pulverizing the coarsely pulverized product, usable are, for example, a jet-type pulverizer using supersonic jet stream for the pulverization, and an impact-type pulverizer in which the coarsely pulverized product is introduced into a space formed between a rotor rotating at high speed and a linear acting as a stator and then pulverized therein.

Note that the melt-kneaded product cooled and solidified may be directly pulverized by the jet-type pulverizer, the impact-type pulverizer, or the like device, without coarse pulverization by means of the hammer mill, the cutting mill, or the like device.

In the pulverizing step, an amount of air supply is appropriately adjusted in the case of a pulverizer using air, or a rotor rotation speed is appropriately adjusted in the case of a pluverizer using a rotor, to thereby control the particle size distribution and number distribution of the toner. This control makes is possible to provide a toner of which particles show preferred size distribution and number distribution, to be specific, of which particles have a volume average particle size of 5.0 μm or more and 7.0 μm or less and of which 5.0 μm-sized or smaller particles account for less than 40% by number.

[First Classifying Step]

In the first classifying step S4, excessively pulverized toner particles and coarse toner particles are removed from the first pulverized product obtained in the pulverizing step, to thereby obtain the first toner particle group. The excessively pulverized toner particles and the coarse toner particles will be collected and able to be reused for manufacture of another toner.

For the classification, a known classifier is usable by which the excessively pulverized toner particles and the coarse toner particles can be removed through classification using centrifugal force or wind force. The known classifier includes, for example, a swivel pneumatic classifier (rotary pneumatic classifier).

In the first classifying step, the classification is preferably conducted under such appropriately adjusted classification conditions that the toner particles obtained through the classification will have a volume average particle size of 5.5 μm or more and 6.5 μm or less. If the toner particles have a volume average particle size of less than 5.5 μm, a content of small particles in the toner may be too high and therefore lead to a decrease in the cleaning property. If the toner particles have a volume average particle size over 6.5 μm, it may mean that the toner particles have too large a volume average particle size to form high-definition images. Besides, the toner particles have a decreased specific surface area, resulting in a smaller charge amount of the toner, which means that the toner may not be stably supplied to the image bearing member and may spatter and cause contamination inside the device.

The above-stated classification conditions to be adjusted include, for example, a rotation speed of a classification rotor in the swivel pneumatic classifier (rotary pneumatic classifier).

[Spheronizing Step]

In the embodiment, the second pulverized product obtained through the pulverizing step is then subject to a spheronizing process using mechanical impact or hot air in the pulverizing step S5, thus resulting in spheronized particles of the second pulverized product. In the embodiment, it is preferable that the spheronizing process is not applied to the first pulverized product and the first toner particle group while being applied to at least either the second pulverized product or the second toner particle group.

In general, as the toner particles have smaller sizes, it is harder to remove by a cleaning blade the toner which has failed to be transferred and remains on the image bearing member, leading to a decreased cleaning property. This tendency that the cleaning property is decreased with smaller toner particles, becomes more prominent as the toner particles have less corrugated surfaces owing to the spheronization. Moreover, as larger toner particles have more corrugated surfaces, the toner particle-to-particle physical adherence will more easily lose its balance with respect to the image bearing member. In the case of treating neither the first pulverized product nor the first toner particle group but at least either the second pulverized product or the second toner particle group with the spheronizing process, the toner particles having a small volume average particle size can be provided with more corrugated surfaces while the toner particles having a large volume average particles size can be provided with less corrugated surfaces, resulting in toner particles as a whole with a favorable cleaning property. Consequently, it is possible to provide a toner which causes no fog and is capable of stably forming high-quality images with high definition and high resolution over a long period of time.

Examples of the spheronization processing method include a spheronizing method using mechanical impact and a spheronizing method using hot air, and it is preferable to adopt the spheronizing method using mechanical impact in which particles can be spheronized with their corrugated surfaces remaining to a proper extent. In the thermally-spheronizing process, the toner particles are fused and thereby bonded each other, which may cause the release agent contained in the toner particles to bleed out on the surfaces thereof, resulting in a decrease in flowability of the toner.

A usable example of the impact-type spheronizing device for the spheronizing process using mechanical impact is a commercially-available device including FACULTY (trade name) manufactured by Hosokawa Micron Corporation. A usable example of the hot-air-type spheronizing device for the spheronizing process using hot air is a commercially-available device including a surface modifying system: METEORAINBOW (trade name) manufactured by Nippon Pneumatic MFG. Co., Ltd.

The spheronizing process is preferably carried out so that the degree of circularity of the toner particles falls in the above-stated preferable range, to be specific, in the range of 0.950 or more and 0.960 or less.

In another embodiment of the invention, the first pulverized product may be treated with the spheronizing process right after the pulverizing step S3. Alternatively, the first toner particle group may be treated with the spheronizing process right after the first classifying step S4, and the second toner particle group may be treated with the spheronizing process right after the second classifying step S6, or the mixed toner particles may be treated with the spheronizing process right after the mixing step S7. Ultimately, the spheronizing step does not have to be carried out.

[Second Classifying Step]

In the second classifying step S6, excessively pulverized toner particles and coarse toner particles are removed by a classifier from the spheronized toner particles of the second pulverized product obtained in the spheronizing step. The second toner particle group is thus prepared. The excessively pulverized toner particles and the coarse toner particles will be collected and able to be reused for manufacture of another toner.

For the classification, a known classifier is usable by which the excessively pulverized toner particles and the coarse toner particles can be removed through classification using centrifugal force or wind force. The known classifier includes, for example, a swivel pneumatic classifier (rotary pneumatic classifier).

In the classifying step, the classification is preferably conducted under such appropriately adjusted classification conditions that the toner particles obtained through the classification will have a volume average particle size of 7.3 μm or more and 8.3 μm or less. If the toner particles have a volume average particle size of less than 7.3 μm, the content of the small particles in the toner may be too high and therefore lead to a decrease in the cleaning property. If the toner particles have a volume average particle size over 8.3 μm, it may mean that the toner particles have too large a volume average particle size to form high-definition images. Besides, the toner particles have a decreased specific surface area, resulting in a smaller charge amount of the toner, which means that the toner may not be stably supplied to the image bearing member and may spatter and cause contamination inside the device.

The above-stated classification conditions to be adjusted include, for example, a rotation speed of a classification rotor in the swivel pneumatic classifier (rotary pneumatic classifier).

The spheronizing step S5 and the second classifying step S6 may be conducted at the same time or in reverse order depending on a type of device for use in the spheronizing step.

[Mixing Step]

In the mixing step S7, the first toner particle group prepared by way of the first classifying step S4 and the second toner particle group prepared by way of the spheronizing step S5 and the second classifying step S6 are mixed with each other, and a toner of the present embodiment is thus manufactured.

The mixer used in the mixing step includes, for example, a Henschel-type mixing device such as FMMIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

In the present embodiment, the second toner particle group is mixed preferably in the weight ratio of 5 parts by weight or more and 120 parts by weight or less to 100 parts by weight of the first toner particle group. If the second toner particle group is mixed in the weight ratio of less than 5 parts by weight to 100 parts by weight of the first toner particle group, the area of contact of the resultant toner with an image bearing member and an intermediate transfer medium will be wider, leading to a lower transfer efficiency of the toner, and therefore images formed with the toner on rough-surface recording mediums will have image-missing parts, which means lower image reproducibility, as compared to the case where the weight ratio of the mixed second toner particle group is 5 parts by weight or more. Moreover, in the fixing step, the toner particles have wider space therebetween and may therefore form a toner image having too low thermal conductivity to obtain a favorable low-temperature fixing property. Furthermore, the toner particles are not controlled to avoid corrugated surfaces, resulting in an increase in an amount of the first toner particle group of which particles tend to have surface charge distribution difficult to be homogenized, and the toner will therefore spatter more easily. In addition, the increase in the content of the toner particles having a small volume average particle size may cause the resultant toner to have lower flowability. If the second toner particle group is mixed in the weight ratio of 120 parts by weight to 100 parts by weight of the first toner particle group, a content of the toner particles having a large volume average particle size is so higher that it becomes difficult to form high-definition images, resulting in lower image reproducibility.

When the first toner particle group and the second toner particle group are mixed in the weight ratio of 100 parts by weight to 5 parts by weight or more and 120 parts by weight or less, the toner particles having a small volume average particle size allows for formation of high-definition images, and the toner will spatter less frequently, thereby allowing for curbed deterioration of images, as well as be provided with a favorable low-temperature fixing property and excellent flowability, resulting in a toner which is capable of stably forming high-quality images with high definition and high resolution over a long period of time.

In the mixing step, the second toner particle group is mixed preferably in the weight ratio of 5 parts by weight or more and 70 parts by weight or less to 100 parts by weight of the first toner particle group. When the second toner particle group is mixed in the weight ratio of 70 parts by weight or less to 100 parts by weight of the first toner particle group, a content of the toner particles having a large volume average particle size is adjusted to a more appropriate level, which makes such an effect more notable that high-definition images can be formed with high reproducibility over a long period of time, as compared to the case where the second toner particle group is mixed in the weight ratio of 5 parts by weight or more and 120 parts by weight or less to 100 parts by weight of the first toner particle group.

Completion of the mixing step indicates the end of the process of manufacturing the toner according to the present embodiment. In another embodiment of the invention, right after the mixing step, the toner may be mixed with an external additive, or an externally adding step may be provided in which an external additive is added to the toner.

3. Developer

The toner of the invention manufactured as above can be used as one-component developer without change and can also be mixed with a carrier to be used in form of a two-component developer. That is to say, the developer according to one embodiment of the invention contains the toner of the invention. The developer can be therefore provided with a favorable fixing property and favorable charging stability as well as other properties stable with based resin, a styrene-acrylic resin, a silicone-based resin, an ester-based resin, and a fluorine-containing polymer-based resin. The resin used for the dispersed-in-resin carrier includes, but is not particularly limited either to, for example, a styrene-acrylic resin, a polyester resin, a fluorine-based resin, and a phenol resin.

A shape of the carrier is preferably spherical or flat.

Further, the volume average particle size of the carrier is not particularly limited, and in consideration of enhancement in image quality, it is preferably 10 μm to 100 μm and more preferably 30 μm or more and 50 μm or less. If the volume average particle size of the carrier is less than 10 μm, magnetic force acting between the carrier and the developing roller is weaker, which makes it easier to cause the toner to be developed with the toner in the developing step, as compared to the case where the volume average particle size of the carrier is 10 μm or more. If the volume average particle size of the carrier exceeds 100 μm, each toner particle may not be sufficiently charged. When the carrier has a volume average particle size of 10 μm or more and 100 μm or less, the toner and the carrier are able to come into contact with each other more frequently, so that charge on each toner particle can be controlled to provide a toner with sufficient chargeability, as compared to the case where the volume average particle size of the carrier exceeds 100 μm. It is therefore possible to obtain a two-component developer having a favorable toner developing property. The above-mentioned effects can be exerted more stably with the carrier having a volume average particle size of 30 μm or more and 50 μm or less.

In the present embodiment, the volume average particle size of the carrier is measured by use of a particle size analyzer using the laser diffraction and scattering method: MICROTRAC MT3000 (trade name) manufactured by Nikkiso Co., Ltd.

Furthermore, resistivity of the carrier is preferably $10^8$ Ω·cm or more and more preferably $10^{12}$ Ω·cm or more. The carrier's resistivity is obtained as follows. The carrier is put in a vessel having a cross-sectional area of 0.50 $cm^2$ and crammed in the vessel by tapping and then, a load of 1 $kg/cm^2$ is imposed on the carrier in the vessel while a voltage is applied between the load and a bottom electrode to generate an electric field of 1,000 V/cm there. In the situation just described, a current value is read from which the carrier's resistivity is derived. The low resistivity will cause charge injection into a carrier when a bias voltage is applied to the developing sleeve, and this makes the carrier particles become more likely to adhere to a photoreceptor. In addition, this induces breakdown of the bias voltage more frequently.

Magnetization intensity (maximum magnetization) of the carrier is preferably 10 emu/g to 60 emu/g, and more preferably 15 emu/g to 40 emu/g. The magnetization intensity depends on magnetic flux density of the developing roller. Under a condition that the developing roller has normal magnetic flux density, the magnetization intensity less than 10 emu/g will lead to a failure to exercise magnetic binding force, which may cause the carrier to spatter. When the magnetization intensity exceeds 60 emu/g, it becomes difficult to keep a noncontact state with an image bearing member in a noncontact development where brush of the carrier is too high, and in a contact development, sweeping patterns may appear more frequently in a toner image.

A use ratio between the toner and the carrier contained in the two-component developer is not particularly limited and may be appropriately selected according to kinds of the toner and the carrier. To take the case of the resin-coated carrier (having density of 5 g/cm$^2$ to 8 g/cm$^2$) as an example, it is preferable to use the toner in such an amount that the content of the toner in the developer is 2% by weight or more and 30% by weight or less, more preferably 2% by weight or more and 20% by weight or less, of a total amount of the developer. Further, in the two-component developer, the coverage of the toner over the carrier is preferably 40% or more and 80% or less.

4. Image Forming Apparatus

Figure 2:
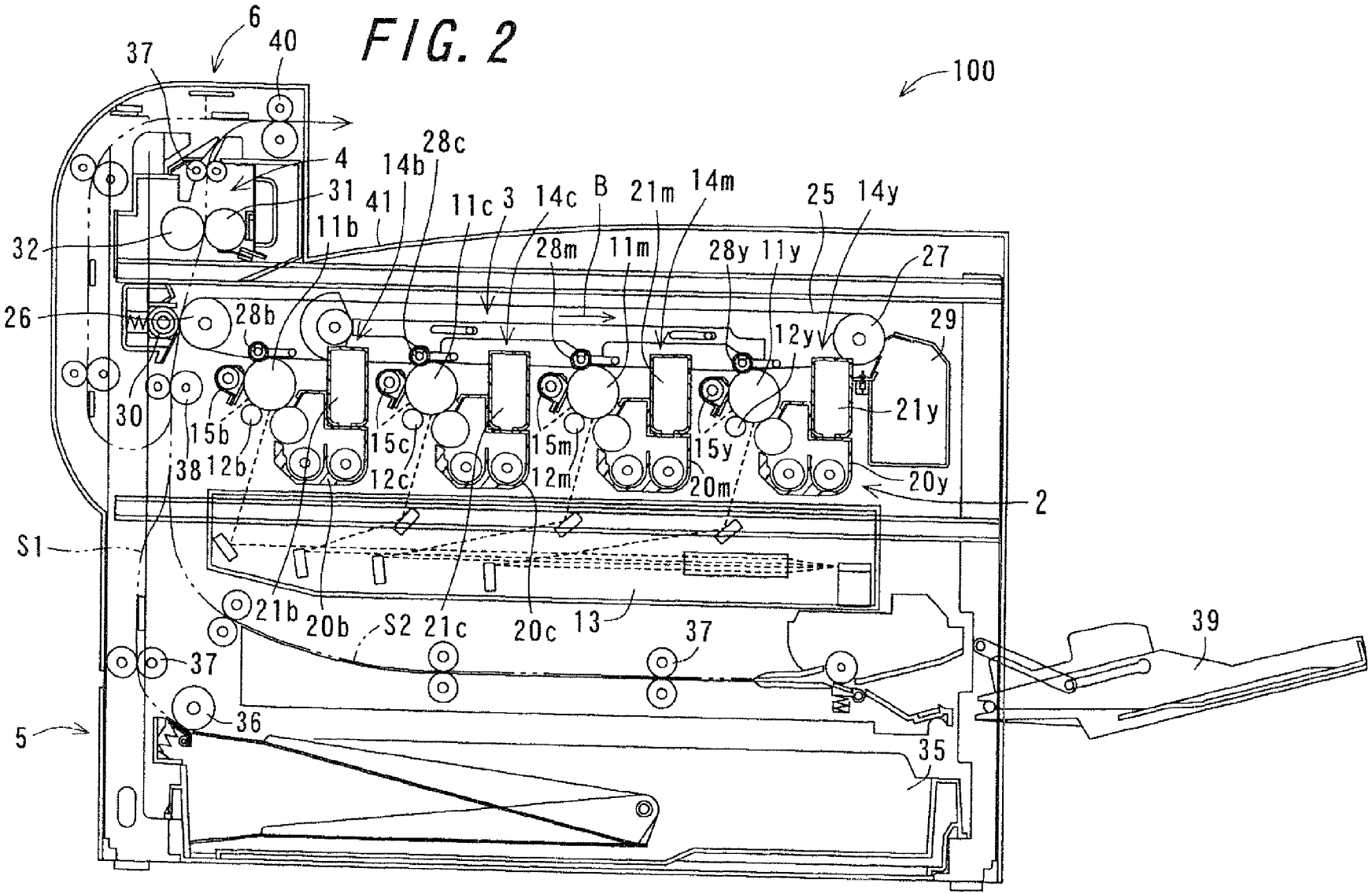
FIG. 2 is a schematic view showing a configuration of an image forming apparatus according to one embodiment of the invention.

FIG. 2 is a schematic view showing a configuration of an image forming apparatus 100 according to one embodiment of the invention. The image forming apparatus 100 is a multifunctional peripheral having a copier function, a printer function, and a facsimile function together, and according to image information being conveyed to the image forming-apparatus 100, a full-color or monochrome image is formed on a recording medium. That is, the image forming apparatus 100 has three types of print mode, i.e., a copier mode, a printer mode and a FAX mode, and the print mode is selected by a control unit (not shown) in accordance with, for example, the operation input from an operation portion (not shown) and reception of the printing job from external equipment such as a personal computer, a mobile device, an information recording storage medium, and a memory device.

The image forming apparatus 100 includes a photoreceptor drum 11 serving as an image bearing member, an image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the image forming section 2 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The image forming section 2 includes a charging section 12, an exposure unit 13, a developing device 14, and a cleaning unit 15. The charging section 12 and the exposure unit 13 each function as a latent image forming section. The charging section 12, the developing device 14, and the cleaning unit 15 are disposed around the photoreceptor drum 11 in the order just stated. The charging section 12 is disposed vertically below the developing device 14 and the cleaning unit 15.

The photoreceptor drum 11 is a roller-shaped member which is disposed so as to rotatable about an axis thereof by a rotation-driving section (not shown) and on which surface part an electrostatic latent image is formed. The rotation-driving section of the photoreceptor drum 11 is controlled by a control unit composed of a central processing unit (CPU). The photoreceptor drum 11 includes a conductive substrate (not shown) and a photosensitive layer (not shown) formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material.

As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing at least conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the charging property of the photosensitive layer can be enhanced under a low temperature circumstance and/or a low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charge under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bis-stilbene skeleton, distyryloxadiazole skeleton, or di-styryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more thereof may be used in combination. The content of the charge generating substance is not particularly limited, and preferably 5 parts by weight or more and 500 parts by weight or less, more preferably 10 parts by weight or more and 200 parts by weight or less based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone or, optionally, two or more thereof may be used in combination.

The charge generating layer can be formed by dissolving or dispersing an appropriate amount of a charge generating substance, a binder resin and, optionally, a plasticizer, a sensitizer, etc. respectively in an appropriate organic solvent in which the ingredients described above are dissolvable or dispersible, to thereby prepare a coating solution for charge generating layer, and then applying the coating solution for charge generating layer to the surface of the conductive substrate, followed by drying the coated surface. The thickness of the charge generating layer obtained in this way is not particularly limited, and preferably is 0.05 μm or more and 5 μm or less, more preferably 0.1 μm or more and 2.5 μm or less.

The charge transporting layer stacked over the charge generating layer contains as essential ingredients a charge transporting substance having an ability of receiving and transporting the charge generated from the charge generating substance, and a binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl) propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane; bromanil, chloranil, and benzoquinone. The charge transporting substances may be used each alone, or two or more thereof may be used in combination. The content of the charge transporting substance is not particularly limited, and preferably is 10 parts by weight or more and 300 parts by weight or less, more preferably 30 parts by weight or more and 150 parts by weight or less, based on 100 parts by weight of the binder resin in the charge transporting substance.

As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, an epoxy resin, polyurethane, polyvinylketone, polystyrene, polyacrylamide, a phenolic resin, a phenoxy resin, a polysulfone resin, and a copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resins may be used each alone, or two or more thereof may be used in combination.

The charge transporting layer preferably contains an antioxidant in addition to the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane, and derivatives thereof, an organic sulfur compound, and an organic phosphorus compound. The antioxidants may be used each alone, or two or more thereof may be used in combination. The content of the antioxidant is not particularly limited, and is 0.01% by weight or more and 10% by weight or less, preferably 0.05% by weight or more and 5% by weight or less, of the total amount of the ingredients constituting the charge transporting layer.

The charge transporting layer can be formed by dissolving or dispersing an appropriate amount of a charge transporting substance, a binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer, followed by drying the coated surface. The thickness of the charge transporting layer obtained in this way is not particularly limited, and preferably is 10 μm or more and 50 μm or less, more preferably 15 μm or more and 40 μm or less.

It is also possible to form a photosensitive layer in which a charge generating substance and a charge transporting substance are present in one layer. In this case, the kinds and contents of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 when viewed in a longitudinal direction of the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum 12. It is also possible to use a contact-charging type charger such as a charging brush or a magnetic brush.

The exposure unit 13 is disposed so that light beams corresponding to each color information emitted from the exposure unit 13 pass between the charging section 12 and the developing device 14 and reach the surface of the photoreceptor drum 11. In the exposure unit 13, the image information is converted into light beams corresponding to each color information of black, cyan, magenta, and yellow, and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array and a unit in which a liquid-crystal shutter and a light source are appropriately combined with each other.

The cleaning unit 15 removes the toner which remains on the surface of the photoreceptor drum 11 after the toner image formed on the surface of the photoreceptor drum 11 by the developing device 14 has been transferred to the recording medium, and thus cleans the surface of the photoreceptor drum 11. In the cleaning unit 15, a platy member is used such as a cleaning blade. In the image forming apparatus of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of a charging device. The degraded surface part is, however, worn away by abrasion through the cleaning unit 15 and thus removed reliably, though gradually. Accordingly, the problem of the surface degradation caused by the ozone, etc. is actually solved, and the potential of charge given in the charging operation can be thus maintained stably for a long period of time. Although the cleaning unit 15 is provided in the embodiment, no limitation is imposed on the configuration and the cleaning unit 15 does not have to be provided.

In the image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of the toner image forming operations just described is repeatedly carried out.

The transfer section 3 is disposed above the photoreceptor drum 11 and includes the intermediate transfer belt 25, a driving roller 26, a driven roller 27, four intermediate transfer rollers 28 which respectively correspond to image information of the colors, i.e. black, cyan, magenta, and yellow, a transfer belt cleaning unit 29, and a transfer roller 30. The intermediate transfer belt 25 is an endless belt stretched between the driving roller 26 and the driven roller 27, thereby forming a loop-shaped travel path. The intermediate transfer belt 25 rotates in an arrow B direction. The driving roller 26 can rotate around an axis thereof with the aid of a driving section (not shown), and the rotation of the driving roller 26 drives the intermediate transfer belt 25 to rotate in the arrow B direction. The driven roller 27 can rotate depending on the rotational drive of the driving roller 26, and imparts constant tension to the intermediate transfer belt 25 so that the intermediate transfer belt 25 does not go slack. The intermediate transfer roller 28 is disposed in pressure-contact with the photoreceptor drum 11 across the intermediate transfer belt 25, and capable of rotating around its own axis by a driving section (not shown). The intermediate transfer roller 28 is connected to a power source (not shown) for applying the transfer bias voltage as described above, and has a function of transferring the toner image formed on the surface of the photoreceptor drum 11 to the intermediate transfer belt 25.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transfer roller 28 which is disposed opposite to the photoreceptor drum 11 across the intermediate transfer belt 25, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image.

The transfer belt cleaning unit 29 is disposed opposite to the driven roller 27 across the intermediate transfer belt 25 so as to come into contact with an outer circumferential surface of the intermediate transfer belt 25. The residual toner which is attached to the intermediate transfer belt 25 as it comes into contact with the photoreceptor drum 11, may cause contamination on a reverse side of the recording medium. The transfer belt cleaning unit 29 therefore removes and collects the toner on the surface of the intermediate transfer belt 25.

The transfer roller 30 is disposed in pressure-contact with the driving roller 26 across the intermediate transfer belt 25, and capable of rotating around its own axis by a driving section (not shown). In a pressure-contact portion, i.e., a transfer nip portion, between the transfer roller 30 and the driving roller 26, a toner image which has been carried by the intermediate transfer belt 25 and thereby conveyed to the pressure-contact portion is transferred onto a recording medium fed from the later-described recording medium feeding section 5. The recording medium bearing the toner image is fed to the fixing section 4.

In the transfer section 3, the toner image is transferred from the photoreceptor drum 11 onto the intermediate transfer belt 25 in the pressure-contact portion between the photoreceptor drum 11 and the intermediate transfer roller 28, and by the intermediate transfer belt 25 rotating in the arrow B direction, the transferred toner image is conveyed to the transfer nip portion where the toner image is transferred onto the recording medium.

The fixing section 4 is provided downstream of the transferring section 3 along a conveyance direction of the recording medium, and contains a fixing roller 31 and a pressure roller 32. The fixing roller 31 can rotate by a driving section (not shown), and heats the toner constituting an unfixed toner image borne on the recording medium so that the toner is fused to be fixed on the recording medium. Inside the fixing roller 31 is provided a heating portion (not shown). The heating portion heats the heating roller 31 so that a surface of the heating roller 31 has a predetermined temperature (which may also be hereinafter referred to as "heating temperature"). For the heating portion, a heater, a halogen lamp, and the like device can be used, for example. The heating portion is controlled by a fixing condition controlling portion.

In the vicinity of the surface of the fixing roller 31 is provided a temperature detecting sensor (not shown) which detects a surface temperature of the fixing roller 31. A result detected by the temperature detecting sensor is written to a memory portion of the later-described control unit. The pressure roller 32 is disposed in pressure-contact with the fixing roller 31, and supported so as to be rotate by the rotational drive of the fixing roller 31. The pressure roller 32 helps the toner image to be fixed onto the recording medium by pressing the toner and the recording medium when the heat of the fixing roller 31 fuses the toner and the toner image is thereby fixed onto the recording medium. A pressure-contact portion between the fixing roller 31 and the pressure roller 32 is a fixing nip portion.

In the fixing section 4, the recording medium onto which the toner image has been transferred in the transfer section 3 is nipped by the fixing roller 31 and the pressure roller 32 so that when the recording medium passes through the fixing nip portion, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path S1. The conveying rollers 37 are a pair of roller members disposed in pressure-contact with each other, and convey the recording medium toward the registration rollers 38. The registration rollers 38 are a pair of roller members disposed in pressure-contact with each other, and feed to the transfer nip portion the recording medium fed from the conveying rollers 37 in synchronization with the conveyance of the toner image borne on the intermediate transfer belt 25 to the transfer nip portion. The manual paper feed tray 39 is a device storing recording mediums which are different from the recording mediums stored in the automatic paper feed tray 35 and may have any size and which are to be taken into the image forming apparatus, and the recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip portion in synchronization with the conveyance of the toner image borne on the intermediate transfer belt 25 to the transfer nip portion.

The discharging section 6 includes the conveying rollers 37, discharging rollers 40, and a catch tray 41. The conveying rollers 37 are disposed downstream of the fixing nip portion along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 100. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are input, for example, various set values obtained by way of an operation panel (not shown) disposed on the upper surface of the image forming apparatus 100, results detected from a sensor (not shown) etc. disposed in various portions inside the image forming apparatus 100, and image information obtained from external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus 100. Examples of the external equipment include a computer, a digital camera, a television, a video recorder, a DVD (digital versatile disc) recorder, an HDDVD (high-definition digital versatile disc), a Blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit (abbreviated as CPU). The control unit contains a main power source as well as the above-stated processing circuit. The power source supplies electricity to not only the control unit but also respective devices provided inside the image forming apparatus 100.

5. Developing Device

Figure 3:
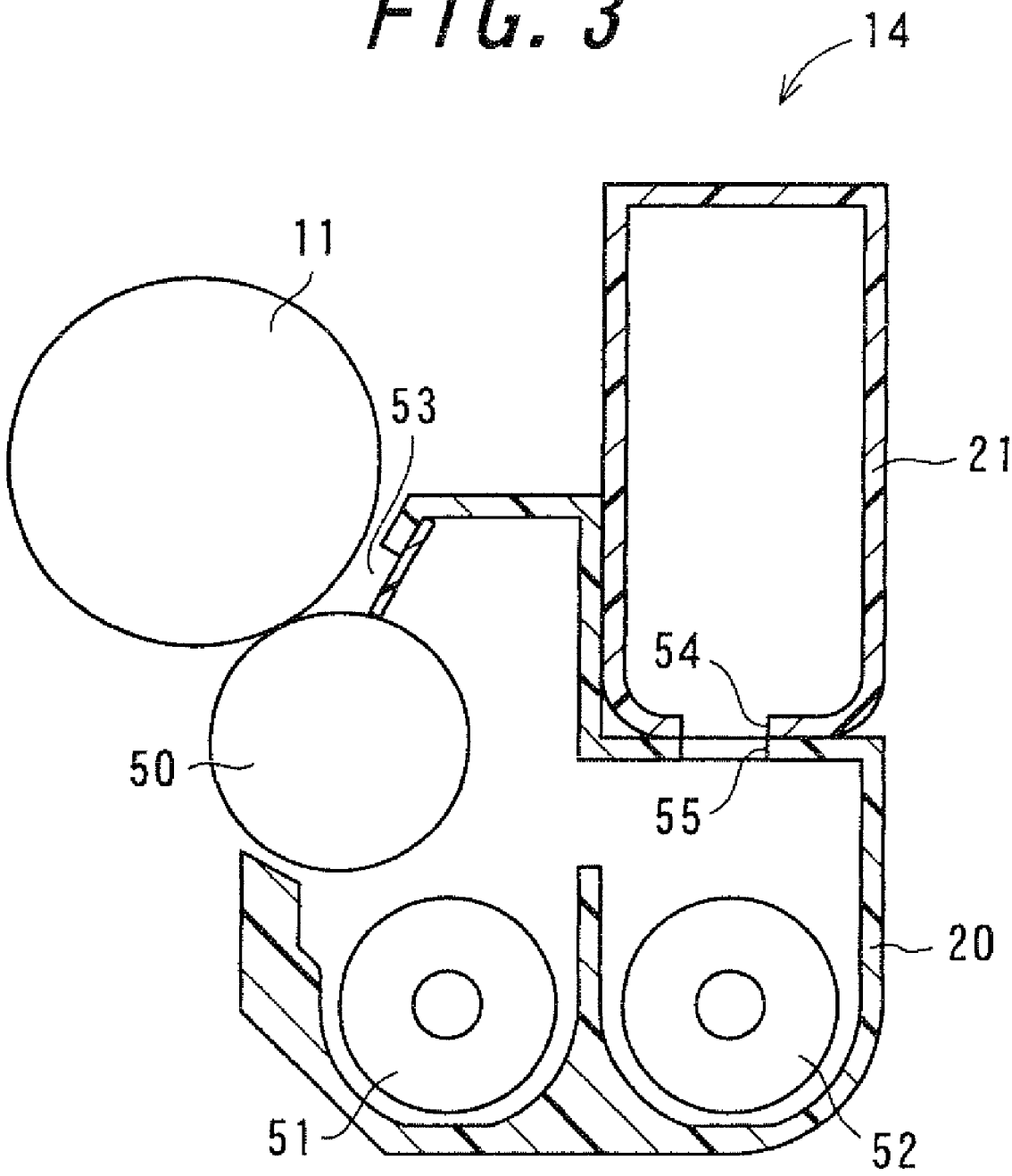
FIG. 3 is a schematic view showing a developing device provided in the image forming apparatus shown in FIG. 2.

FIG. 3 is a schematic view showing the developing device 14 provided in the image forming apparatus 100 shown in FIG. 2. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains the toner in its internal space where roller members such as a developing roller 50, a supplying roller 51, and an agitating roller 52, are placed as being rotatably supported. Instead of the roller members, screw members may be placed in the developing tank 20. In the developing device 14 of the present embodiment, the above-described toner according to one embodiment of the invention is contained in the developing tank 20.

The developing tank 20 has an opening 53 in a side face thereof opposed to the photoreceptor drum 11. The developing roller 50 is rotatably provided at such a position as to face the photoreceptor drum 11 through the opening 53 just stated. The developing roller 50 is a roller-shaped member for supplying a toner to the electrostatic latent image on the surface of the photoreceptor drum 11 in a pressure-contact portion or most-adjacent portion between the developing roller and the photoreceptor drum 11. In supplying the toner, to a surface of the developing roller 50 is applied potential whose polarity is opposite to polarity of the potential of the charged toner, which serves as development bias voltage. By so doing, the toner on the surface of the developing roller 50 is smoothly supplied to the electrostatic latent image. Furthermore, an amount of the toner being supplied to the electrostatic latent image, that is, a toner attachment amount on the electrostatic latent image can be controlled by changing a value of the development bias voltage.

The supplying roller 51 is a roller-shaped member which is rotatably disposed so as to face the developing roller 50 and used to supply the toner to the vicinity of the developing roller 50.

The agitating roller 52 is a roller-shaped member which is rotatably disposed so as to face the supplying roller 51 and used to feed to the vicinity of the supplying roller 51 the toner which is newly supplied from the toner hopper 21 into the developing tank 20. The toner hopper 21 is disposed so as to communicate a toner replenishment port 54 formed in a vertically lower part of the toner hopper 21, with a toner reception port 55 formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

As above, the developing device preferably develops the latent images with use of the developer of the invention. This makes it possible to stably form on the image bearing members toner images having high definition and high resolution. Consequently, high-quality images can be stably formed.

Moreover, as described above, the image forming apparatus is provided preferably with the developing device of the invention which is capable of forming the toner images having high definition and high resolution on the image bearing members. By using such an image forming apparatus to form images, it is possible to stably form images with high definition and high resolution.

With use of the image forming apparatus of the invention, it is possible to form high-quality images without the deterioration of image quality due to the decrease in the flowability of the developer.

EXAMPLES

Values of properties of the toners in Examples and Comparative examples were measured as follows.

<Glass Transition Temperature (Tg) of Binder Resin>

Using a differential scanning calorimeter: DSC220 (trade name) manufactured by Seiko Instruments & Electronics Ltd., 1 g of a sample was heated at a temperature of which increase rate was 10° C./min based on Japanese Industrial Standards (JIS) K7121-1987, thus obtaining a DSC curve. A straight line was drawn toward a low-temperature side extendedly from a base line on the high-temperature side of an endothermic peak corresponding to glass transition of the DSC curve which had been obtained as above. A tangent line was also drawn at a point where a gradient thereof was maximum against a curve extending from a rising part to a top of the peak. A temperature at an intersection of the straight line and the tangent line was determined as the glass transition temperature (Tg).

<Acid Values of Release Agent and Binder Resin>

The acid value of the sample was measured as follows in accordance with a neutralization titration method. The sample in an amount of 5 g was dissolved in 50 mL of THF, to which was then added several drops of an ethanol solution of phenolphthalein as an indicator, and the resultant sample was subjected to titration with a 0.1 mol/L aqueous solution of potassium hydroxide (KOH). The point at which the sample solution underwent a change in color from colorless to magenta was defined as endpoint, and the acid value (mgKOH/g) of the sample was calculated from the amount of the aqueous solution of potassium hydroxide taken to reach the endpoint and the amount of sample used for the titration.

<Melting Temperature of Release Agent>

Using the differential scanning calorimeter: DSC220 (trade name) manufactured by Seiko Instruments & Electronics Ltd., 1 g of the sample was heated from a temperature of 20° C. up to 200° C. at a temperature of which increase rate was 10° C./min, and then an operation of rapidly cooling down the sample from 200° C. to 20° C. was repeated twice, thus obtaining a DSC curve. A temperature obtained at a top of an endothermic peak which corresponds to the melting shown on the DSC curve obtained at the second operation, was determined as the melting temperature.

<Volume Average Particle Size of Toner and Coefficient of Variation (CV Value)>

A volume average particle size of the toner was determined from the particle size distribution of the particle sizes measured in the above measurement condition by use of COULTER MULTISIZER III manufactured by Beckman Coulter, Inc.

Further, a coefficient of variation (CV value, %) was determined based on the following expression (4) using a standard deviation (μm) in the volume particle size distribution. A smaller coefficient of variation means a narrower particle size distribution.

$$CV\text{ value }(\%)=\{\text{Standard deviation }(\mu m)\text{ in volume particle size distribution/Volume average particle size }(\mu m)\}\times 100 \quad (4)$$

<Amount of Release Agent Exposed on Surface of Toner>

One gram of the toner was dispersed in 20 ml of hexane and in dispersion thus formed, a stirrer was put to agitate the dispersion for 10 minutes so as to elute with hexane the release agent contained in the surface layer of the toner. After that, the dispersion was filtered and then dried overnight in a drier set at 40° C. The one gram of the toner obtained after the elusion using hexane was heated from a temperature of 20° C. up to 150° C. at a temperature of which increase rate was 10° C./min, and then an operation of rapidly cooling down the sample from 150° C. to 20° C. was repeated twice, thus obtaining a DSC curve. On the basis of quantity of melting heat derived from the DSC curve obtained at the second operation, heat capacity of the release agent in the toner was calculated. Also for a toner which has not treated with hexane, its heat capacity was calculated in the same manner. And a difference between the heat capacity of these toners was used to estimate the amount of the release agent exposed on the surface layer of the toner.

<Dispersion Diameter of Release Agent Exposed on Surface of Toner>

In a 2-liter beaker, 100 parts of n-hexane (manufactured by Kishida Chemical Co., Ltd.) and a stirrer were placed. Into the beaker, 5 parts of toner particles were poured while the n-hexane is stirred for 10 seconds with the stirrer as the beaker vibrates at 28 kHz with an ultrasonic vibrating rod put therein. By this treatment, the release agent exposed on the surfaces of the toner particles was removed. The toner-particle-containing dispersion inside the beaker was then treated with suction filtration, and the toner particles remaining on the filter paper were dried in a thermo-hygrostat set at 35° C. and 5% RH. The surfaces of the dried toner particles were then coated with metal films (Au film with a thickness of 0.5 μm) by sputter deposition. Using a scanning electron microscope: VE9800 (trade-name) manufactured by KEYENCE CORPORATION, 200 to 300 holes made by the removal of the release agent in the metal film-coated toner were randomly selected and photographed at accelerating voltage of 10 kV and a magnification of 1,000. This electron micrograph data was analyzed by image analysis software: A-ZO KUN (trade name) manufactured by Asahi Kasei Engineering Corporation. A dispersion diameter of the release agent in the surface of the toner was thus determined.

<Coverage of External Additive Over Surface of Toner>

The coverage of the external additive over the surface of the toner represents a ratio of the surface area of the external additive present in the surfaces of the toner to the surface area of the toner containing no external additive (which toner may be hereinafter referred to "toner base particle") The coverage of the external additive can be determined by assigning to the following expression (3) a volume average particle size and absolute specific gravity of the toner base particles which have not yet mixed with the external additive; an average primary particle size and absolute specific gravity of the external additive; and a ratio of a weight of the external additive to a weight of the toner base particles (the weight of the external additive/the weight of the toner base particles).

$$f\ (\%) = \frac{\sqrt{3} \cdot D \cdot \rho t \cdot C}{2\pi \cdot d \cdot \rho i} \times 100 \quad (3)$$

where f represents the coverage of the external additive; D represents the volume average particle size (μm) of the toner base particles; d represents the average primary particle size (μm) of the external additive; ρt represents the absolute specific gravity of the toner base particles; ρi represents the absolute specific gravity of the external additive; and C represents the ratio of the weight of the external additive to the weight of the toner base particles (the weight of the external additive/the weight of the toner base particles).

Hereinafter, the invention will be specifically explained with reference to Examples and Comparative examples.

For the binder resin, polyester resins A to E shown in Table 1 were used.

TABLE 1

| Polyester resin | Acid value (mgKOH/g) | Glass transition temperature Tg (° C.) | Weight average molecular weight (Mw) | Weight average molecular weight (Mw)/Number average molecular weight (Mn) |
|---|---|---|---|---|
| A | 16 | 55 | 12495 | 4 |
| B | 5 | 62 | 57500 | 15.5 |
| C | 30 | 61 | 8300 | 21.1 |
| D | 3 | 58 | 65700 | 17 |
| E | 32 | 59 | 5900 | 18 |

Example 1

Preliminarily Mixing Step

Using a Henschel mixer, the following materials were mixed for 10 minutes: 81.8 parts by weight of polyester resin A; 12 parts by weight of master batch (containing 40% by weight of C.I. pigment red 57:1); 5.0 parts by weight of paraffin wax which serves as a release agent: HNP10 (trade name) manufactured by Nippon Seiro Co., Ltd., having an acid value of zero mgKOH/g and a melting temperature of 75° C.; and 1.5 parts by weight of alkyl salicylate metal salt which serves as a charge control agent: BONTRON E-84 (tradename) manufactured by Orient Chemical Industries, Ltd. An admixture was thus prepared.

[Melt-Kneading Step]

The above admixture was then melt-kneaded by an open roll-type continuous kneader: MOS320-1800 (trade name) manufactured by Mitsui Mining Co., Ltd. A melt-kneaded product was thus prepared.

[Pulverizing Step]

The melt-kneaded product was coarsely pulverized by means of a cutting mill: VM-16 (trade name) manufactured by Ryoko Industry Ltd., into a coarsely pulverized product which was thereafter finely pulverized by a counter jet mill. The first pulverized product and the second pulverized product were prepared, respectively.

[First Classifying Step]

Using a rotary classifier, excessively pulverized toner particles were classified and thus removed from the first pulverized product. The first toner particle group having a volume average particle size of about 5.5 μm was thus prepared.

[Spheronizing Step]

Using an impact-type spheronizing device: FACULTY F-600 (trade name) manufactured by Hosokawa Micron Corporation, the second pulverized product was treated with the spheronizing process. A spheronized product resulting from the second pulverized product was thus prepared.

[Second Classifying Step]

Using a rotary classifier, excessively pulverized toner particles were classified and thus removed from the spheronized product of the second pulverized product. The second toner particle group having a volume average particle size of about 6.5 μm was thus prepared.

[Mixing Step]

With 100 parts by weight of the first toner particle group, 50 parts by weight of the second toner particle group was mixed. A toner was thus prepared.

[Externally Adding Step]

With 100 parts by weight of the toner, 3.8 parts by weight in total of the external additives were mixed by the Henschel mixer: FMMIXER (trade name) manufactured by Mitsui Mining Co., Ltd. The external additives consisted of 2.2 parts by weight of hydrophobic silica: R-974 (trade name) manufactured by Nippon Aerosil Co., Ltd. and 1.6 parts by weight of hydrophobic titanium: T-805 (trade name) manufactured by Nippon Aerosil Co., Ltd. A toner of Example 1 was thus prepared (of which toner was covered at 80% with the external additive). The toner particles of Example 1 had a volume average particle size of 5.9 μm with 37% by number of the toner particles having a number average particle size of 5.0 μm or less.

[Preparation of Two-Component Developer]

A ferrite core carrier having a volume average particle size of 45 μm was used as a carrier. The carrier was mixed with the toner for 20 minutes by means of a V-type mixer: V-5 (trade name) manufactured by Tokuju Corporation so that the coverage of the toner over the carrier became 60%. A two-component developer containing the toner of Example 1 was thus prepared.

Example 2

A toner of Example 2 and a two-component developer containing the toner were manufactured in the same manner as in Example 1, except that the amount of the release agent added in the preliminarily mixing step was changed from 5.0 parts by weight to 5.8 parts by weight.

Example 3

A toner of Example 3 and a two-component developer containing the toner were manufactured in the same manner as in Example 1, except that the amount of the release agent added in the preliminarily mixing step was changed from 5.0 parts by weight to 4.2 parts by weight.

Example 4

A toner of Example 4 and a two-component developer containing the toner were manufactured in the same manner as in Example 3, except that the amount of the release agent added in the preliminarily mixing step was changed from 5.0 parts by weight to 3.0 parts by weight.

Example 5

A toner of Example 5 and a two-component developer containing the toner were manufactured in the same manner as in Example 1, except that the amount of the release agent added in the preliminarily mixing step was changed from 5.0 parts by weight to 2.2 parts by weight.

Example 6

A toner of Example 6 and a two-component developer containing the toner were manufactured in the same manner as in Example 1, except that in the melt-kneading step, a twin screw extruder: PCM65 (trade name) manufactured by Ikegai, Ltd. was used for the melt-kneading process, instead of the open roll-type continuous kneader.

Example 7

A toner of Example 7 and a two-component developer containing the toner were manufactured in the same manner as in Example 1, except that the pulverizing conditions in the pulverizing step and the classifying conditions in the first and second classifying steps were so changed that the toner particles containing the external additive had a volume average particle size of 4.8 μm with 42% by number of the toner particles having a volume average particle size of 5.0 μm or less.

Example 8

A toner of Example 8 and a two-component developer containing the toner were manufactured in the same manner as in Example 1, except that the pulverizing conditions in the pulverizing step and the classifying conditions in the first and second classifying steps were so changed that the toner containing the external additive had a volume average particle size of 7.2 μm with 23% by number of the toner particles having a volume average particle size of 5.0 μm or less.

Example 9

A toner of Example 9 and a two-component developer containing the toner were manufactured in the same manner as in Example 1, except that in the preliminarily mixing step, the paraffin wax was replaced by chemically modified wax: OX-0420 (trade name) manufactured by Nippon Seiro Co., Ltd., having an acid value of 2.7 mgKOH/g and a melting temperature of 89° C.

Example 10

A toner of Example 10 and a two-component developer containing the toner were manufactured in the same manner as in Example 1, except that in the preliminarily mixing step, the paraffin wax having a melting temperature of 75° C. was replaced by paraffin wax having a melting temperature of 62° C., i.e., HNP5 (trade name) manufactured by Nippon Seiro Co., Ltd., having an acid value of zero mgKOH/g and a melting temperature of 62° C.

Example 11

A toner of Example 11 and a two-component developer containing the toner were manufactured in the same manner as in Example 1, except that in the preliminarily mixing step, the polyester resin A was replaced by polyester resin B.

Example 12

A toner of Example 12 and a two-component developer containing the toner were manufactured in the same manner as in Example 1, except that in the preliminarily mixing step, the polyester resin A was replaced by polyester resin C.

Example 13

A toner of Example 13 and a two-component developer containing the toner were manufactured in the same manner as in Example 1, except that in the preliminarily mixing step, the polyester resin A was replaced by polyester resin D.

Example 14

A toner of Example 11 and a two-component developer containing the toner were manufactured in the same manner as in Example 1, except that in the preliminarily mixing step, the polyester resin A was replaced by polyester resin E.

Example 15

A toner of Example 15 (of which toner was covered at 40% with the external additive) and a two-component developer containing the toner were manufactured in the same manner as in Example 1, except that in mixing with the external additive, a total of 1.9 parts by weight of hydrophobic silica and hydrophobic titanium were externally added as external additives; specifically, the amount of hydrophobic silica: R-974 (trade name) manufactured by Nippon Aerosil Co., Ltd. was changed from 2.2 parts by weight to 1.1 parts by weight, and the amount of hydrophobic titanium: T-805 (trade name) manufactured by Nippon Aerosil Co., Ltd. was changed from 1.6 parts by weight to 0.8 part by weight.

Example 16

A toner of Example 16 (of which toner was covered at 50% with the external additive) and a two-component developer containing the toner were manufactured in the same manner as in Example 1, except that in mixing with the external additive, a total of 2.4 parts by weight of hydrophobic silica and hydrophobic titanium were externally added as external additives; specifically, the amount of hydrophobic silica: R-974 (trade name) manufactured by Nippon Aerosil Co., Ltd. was changed from 2.2 parts by weight to 1.4 parts by weight, and the amount of hydrophobic titanium: T-805 (trade name) manufactured by Nippon Aerosil Co., Ltd. was changed from 1.6 parts by weight to 1.0 part by weight.

Example 17

A toner of Example 17 (of which toner was covered at 110% with the external additive) and a two-component developer containing the toner were manufactured in the same manner as in Example 1, except that in mixing with the external additive, a total of 5.2 parts by weight of hydrophobic silica and hydrophobic titanium were externally added as external additives; specifically, the amount of hydrophobic silica: R-974 (trade name) manufactured by Nippon Aerosil Co., Ltd. was changed from 2.2 parts by weight to 3.0 parts by weight, and the amount of hydrophobic titanium: T-805 (trade name) manufactured by Nippon Aerosil Co., Ltd. was changed from 1.6 parts by weight to 2.2 part by weight.

Example 18

A toner of Example 18 (of which toner was covered at 120% with the external additive) and a two-component developer containing the toner were manufactured in the same manner as in Example 1, except that in mixing with the external additive, a total of 5.7 parts by weight of hydrophobic silica and hydrophobic titanium were externally added as external additives; specifically, the amount of hydrophobic silica: R-974 (trade name) manufactured by Nippon Aerosil Co., Ltd. was changed from 2.2 parts by weight to 3.8 parts by weight, and the amount of hydrophobic titanium: T-805 (trade name) manufactured by Nippon Aerosil Co., Ltd. was changed from 1.6 parts by weight to 2.4 part by weight.

Example 19

A toner of Example 19 (of which toner was covered at 130% with the external additive) and a two-component developer containing the toner were manufactured in the same manner as in Example 1, except that in mixing with the external additive, a total of 6.2 parts by weight of hydrophobic silica and hydrophobic titanium were externally added as external additives; specifically, the amount of hydrophobic silica: R-974 (trade name) manufactured by Nippon Aerosil Co., Ltd. was changed from 2.2 parts by weight to 3.6 parts by weight, and the amount of hydrophobic titanium: T-805 (trade name) manufactured by Nippon Aerosil Co., Ltd. was changed from 1.6 parts by weight to 2.6 part by weight.

Example 20

A toner of Example 20 and a two-component developer containing the toner were manufactured in the same manner as in Example 1, except that the first pulverized product was also treated with the spheronizing process just as the second pulverized product was.

Example 21

A toner of Example 21 and a two-component developer containing the toner were manufactured in the same manner as in Example 1, except that neither the first pulverized product nor the second pulverized product was treated with the spheronizing process; that is, no spheronizing step was provided.

Example 22

A toner of Example 22 and a two-component developer containing the toner were manufactured in the same manner as in Example 1, except that the amount of the second toner particle group added in the mixing step was changed from 50 parts by weight to 65 parts by weight.

Example 23

A toner of Example 23 and a two-component developer containing the toner were manufactured in the same manner as in Example 1, except that the amount of the second toner particle group added in the mixing step was changed from 50 parts by weight to 75 parts by weight.

Example 24

A toner of Example 24 and a two-component developer containing the toner were manufactured in the same manner as in Example 1, except that the amount of the second toner particle group added in the mixing step was changed from 50 parts by weight to 95 parts by weight.

Example 25

A toner of Example 25 and a two-component developer containing the toner were manufactured in the same manner as in Example 1, except that the amount of the second toner particle group added in the mixing step was changed from 50 parts by weight to 105 parts by weight.

Example 26

A toner of Example 26 and a two-component developer containing the toner were manufactured in the same manner as in Example 1, except that the amount of the second toner particle group added in the mixing step was changed from 50 parts by weight to 115 parts by weight.

Example 27

A toner of Example 27 and a two-component developer containing the toner were manufactured in the same manner as in Example 1, except that the amount of the second toner particle group added in the mixing step was changed from 50 parts by weight to 125 parts by weight.

Example 28

A toner of Example 28 and a two-component developer containing the toner were manufactured in the same manner as in Example 1, except that the amount of the second toner particle group added in the mixing step was changed from 50 parts by weight to 6 parts by weight.

Example 29

A toner of Example 29 and a two-component developer containing the toner were manufactured in the same manner as in Example 1, except that the amount of the second toner particle group added in the mixing step was changed from 50 parts by weight to 3 parts by weight.

Example 30

A toner of Example 30 and a two-component developer containing the toner were manufactured in the same manner as in Example 1, except that in preparing the two-component developer, a carrier having a volume average particle size of 55 μm was used instead of the carrier particles having a volume average particle size of 45 μm.

Example 31

Preparation of Fine Resin Particles A

As a binder resin for encapsulation, fine resin particles A of styrene-acrylic resin were prepared as follows.

In a reaction vessel having a stirring device, a thermometer, a nitrogen-inducing pipe and a cooling pipe, 20 parts by weight of sodium dodecyl sulfate, which will serve as an emulsifier, and 1680 parts by weight of deionized water were inputted and then heated in a nitrogen atmosphere until an internal temperature of the reaction vessel became 70° C. Into the solution thus obtained, 4440 parts by weight of a monomer admixture (pre-emulsion) of the following composition and 560 parts by weight of a polymerization initiator solution were simultaneously put in drops for 90 minutes at temperature maintained at 70° C. The polymerization initiator solution was prepared by dissolving 5 parts by weight of ammonium peroxodisulfate in 620 parts by weight of deionized water. Drip rates of the monomer admixture (pre-emulsion) and the polymerization initiator solution were adjusted so that these solutions were all put for 90 minutes.

<Composition of Monomer Admixture>

| | |
|---|---|
| Sodium dodecyl sulfate (emulsifier) | 20 parts by weight |
| Deionized water | 2520 parts by weight |
| Styrene | 500 parts by weight |
| n-butylacrylate | 300 parts by weight |
| Methyl methacrylate | 1000 parts by weight |
| Ethyleneglycol dimethacrylate | 100 parts by weight |

After completion of the instillation of the monomer admixture and the polymerization initiator solution, the obtained reaction solution in the reaction vessel was stirred for three hours at temperature maintained at 100° C., resulting in the fine resin particles A having a number average molecular weight Mn of 3900, a weight average molecular weight Mw of 31000, a glass transition temperature Tg of 64° C., and a melting temperature of 130° C. The fine resin particles A thus obtained had a volume average particle size of 0.3 μm.

The toner obtained after the mixing step in Example 1 was used as core particles, and 100 parts by weight of these core particles and 4.0 parts by weight of the fine resin particles A were put in a Henschel mixer: FM-20 (trade name) manufactured by Mitsui Mining Co., Ltd., and thereby mixed for ten minutes into an admixture which was then heated with hot air by using a hot-air treatment equipment: a surface modifying system METEORAINBOW MR-10A (trade name) manufactured by Nippon Pneumatic MFG. Co., Ltd. so that the fine resin particles A are fused to each other to form a shell layer on surfaces of the core particles, thus resulting in a toner of Example 31 of which at least a part of surface was encapsulated. Using the toner of Example 31, a two-component developer containing the toner of Example 31 was prepared in the same manner as in Example 1.

Comparative Example 1

A toner of Comparative example 1 and a two-component developer containing the toner were manufactured in the same manner as in Example 1, except that the amount of the release agent added in the preliminarily mixing step was changed from 5.0 parts by weight to 2.0 parts by weight.

Comparative Example 2

A toner of Comparative example 2 and a two-component developer containing the toner were manufactured in the same manner as in Example 1, except that the amount of the release agent added in the preliminarily mixing step was changed from 5.0 parts by weight to 6.3 parts by weight.

Comparative Example 3

A toner of Comparative example 3 and a two-component developer containing the toner were manufactured in the same manner as in Example 1, except that the paraffin wax was replaced by alcohol modified wax: PARACOHL5070 (trade name) manufactured by Nippon Seiro Co., Ltd., having an acid value of 4 mgKOH/g and a melting temperature of 83° C.

Comparative Example 4

A toner of Comparative example 4 and a two-component developer containing the toner were manufactured in the same manner as in Example 1, except that in the preliminarily mixing step, 7.0 parts by weight of polypropylene wax: VISCOL660P (trade name) manufactured by Sanyo Chemical Industries, Ltd., having an acid value of zero KOH/g and a melting temperature of 145° C. was used as a release agent instead of 5.0 parts by weight of the paraffin wax, and 6 parts by weight of carbon black (BPL) manufactured by Cabot Corporation was added as a colorant instead of 12 parts by weight of the master batch containing 40% by weight of C.I. Pigment Red 57:1, and that in the melt-kneading step, a twin screw extruder: PCM65 (trade name) manufactured by Ikegai, Ltd. was used instead of the open roll-type continuous kneader.

Table 2 collectively shows properties of the toners and the two-component developers containing these toners obtained in Examples 1 to 31 and Comparative examples 1 to 4.

In Table 2, as to a toner, a volume average particle size and a ratio of 5.0 μm or smaller toner particles represent the volume average particle size and the ratio of the toner particles having a number average particles size of 5.0 μm or less, respectively, of the toner to which the external additive has not yet been added.

TABLE 2

| | Release agent | | | | | |
|---|---|---|---|---|---|---|
| | Amount exposed on toner [wt. %] | Dispersion diameter [nm] | Acid value [mgKOH/g] | Melting temperature [° C.] | Amount added [wt. part] | Binder resin Acid value [mgKOH/g] |
| Ex. 1 | 1.8 | 160 | 0 | 75 | 5.0 | 16 |
| Ex. 2 | 2.4 | 211 | 0 | 75 | 5.8 | 16 |
| Ex. 3 | 1.2 | 155 | 0 | 75 | 4.2 | 16 |
| Ex. 4 | 1.0 | 148 | 0 | 75 | 3.0 | 16 |
| Ex. 5 | 0.6 | 107 | 0 | 75 | 2.2 | 16 |
| Ex. 6 | 2.1 | 324 | 0 | 75 | 5.0 | 16 |
| Ex. 7 | 2.0 | 213 | 0 | 75 | 5.0 | 16 |
| Ex. 8 | 1.6 | 161 | 0 | 75 | 5.7 | 16 |
| Ex. 9 | 1.4 | 131 | 2.7 | 89 | 5.0 | 16 |
| Ex. 10 | 1.7 | 146 | 0 | 62 | 5.0 | 16 |
| Ex. 11 | 1.8 | 130 | 0 | 75 | 5.0 | 5 |
| Ex. 12 | 1.8 | 191 | 0 | 75 | 5.0 | 30 |
| Ex. 13 | 1.8 | 106 | 0 | 75 | 5.0 | 3 |
| Ex. 14 | 1.8 | 229 | 0 | 75 | 5.0 | 32 |
| Ex. 15 | 1.8 | 160 | 0 | 75 | 5.0 | 16 |
| Ex. 16 | 1.8 | 160 | 0 | 75 | 5.0 | 16 |
| Ex. 17 | 1.8 | 160 | 0 | 75 | 5.0 | 16 |
| Ex. 18 | 1.8 | 160 | 0 | 75 | 5.0 | 16 |

TABLE 2-continued

| | | | | | | |
|---|---|---|---|---|---|---|
| Ex. 19 | 1.8 | 160 | 0 | 75 | 5.0 | 16 |
| Ex. 20 | 2.0 | 174 | 0 | 75 | 5.0 | 16 |
| Ex. 21 | 1.6 | 129 | 0 | 75 | 5.0 | 16 |
| Ex. 22 | 1.6 | 130 | 0 | 75 | 5.0 | 16 |
| Ex. 23 | 1.6 | 133 | 0 | 75 | 5.0 | 16 |
| Ex. 24 | 1.6 | 130 | 0 | 75 | 5.0 | 16 |
| Ex. 25 | 1.7 | 161 | 0 | 75 | 5.0 | 16 |
| Ex. 26 | 1.6 | 190 | 0 | 75 | 5.0 | 16 |
| Ex. 27 | 1.7 | 177 | 0 | 75 | 5.0 | 16 |
| Ex. 28 | 1.7 | 196 | 0 | 75 | 5.0 | 16 |
| Ex. 29 | 1.8 | 188 | 0 | 75 | 5.0 | 16 |
| Ex. 30 | 1.8 | 160 | 0 | 75 | 5.0 | 16 |
| Ex. 31 | 0.5 | 156 | 0 | 75 | 5.0 | 16 |
| Com. ex. 1 | 0.4 | 98 | 0 | 75 | 2.0 | 16 |
| Com. ex. 2 | 2.7 | 235 | 0 | 75 | 6.3 | 16 |
| Com. ex. 3 | 1.5 | 172 | 4 | 83 | 5.0 | 16 |
| Com. ex. 4 | 4.1 | 427 | 0 | 145 | 7.0 | 16 |

| | Toner | | Mix ratio of spheronized toner | | |
|---|---|---|---|---|---|
| | Volume average particle size [μm] | Ratio of 5.0 μm or smaller particles [number %] | particles to 100 parts of non-spheronized toner particles [wt. part] | Coverage of external additive over toner [%] | Carrier Volume average particle size [μm] |
| Ex. 1 | 5.9 | 37 | 50 | 80 | 45 |
| Ex. 2 | 6.0 | 35 | 50 | 80 | 45 |
| Ex. 3 | 5.8 | 38 | 50 | 80 | 45 |
| Ex. 4 | 6.1 | 35 | 50 | 80 | 45 |
| Ex. 5 | 5.9 | 36 | 50 | 80 | 45 |
| Ex. 6 | 6.0 | 38 | 50 | 80 | 45 |
| Ex. 7 | 4.8 | 42 | 50 | 80 | 45 |
| Ex. 8 | 7.2 | 23 | 50 | 80 | 45 |
| Ex. 9 | 5.9 | 37 | 50 | 80 | 45 |
| Ex. 10 | 6.0 | 38 | 50 | 80 | 45 |
| Ex. 11 | 5.8 | 37 | 50 | 80 | 45 |
| Ex. 12 | 5.9 | 38 | 50 | 80 | 45 |
| Ex. 13 | 6.1 | 37 | 50 | 80 | 45 |
| Ex. 14 | 6.2 | 33 | 50 | 80 | 45 |
| Ex. 15 | 5.9 | 37 | 50 | 40 | 45 |
| Ex. 16 | 5.9 | 37 | 50 | 50 | 45 |
| Ex. 17 | 5.9 | 37 | 50 | 110 | 45 |
| Ex. 18 | 5.9 | 37 | 50 | 120 | 45 |
| Ex. 19 | 5.9 | 37 | 50 | 130 | 45 |
| Ex. 20 | 5.7 | 38 | All spheronized | 80 | 45 |
| Ex. 21 | 5.9 | 37 | 0 | 80 | 45 |
| Ex. 22 | 6.2 | 34 | 65 | 80 | 45 |
| Ex. 23 | 6.3 | 32 | 75 | 80 | 45 |
| Ex. 24 | 6.0 | 35 | 95 | 80 | 45 |
| Ex. 25 | 6.1 | 33 | 105 | 80 | 45 |
| Ex. 26 | 6.3 | 30 | 115 | 80 | 45 |
| Ex. 27 | 6.4 | 28 | 125 | 80 | 45 |
| Ex. 28 | 5.8 | 39 | 6 | 80 | 45 |
| Ex. 29 | 5.7 | 41 | 3 | 80 | 45 |
| Ex. 30 | 5.9 | 37 | 50 | 80 | 45 |
| Ex. 31 | 6.0 | 36 | 50 | 80 | 45 |
| Com. ex. 1 | 5.8 | 37 | 50 | 80 | 45 |
| Com. ex. 2 | 6.1 | 36 | 50 | 80 | 45 |
| Com. ex. 3 | 5.9 | 37 | 50 | 80 | 45 |
| Com. ex. 4 | 9.3 | 14 | 50 | 80 | 45 |

Using the toners obtained in Examples 1 to 31 and Comparative examples 1 to 4 and the two-component developers containing these toners, long-term use stability, fixing properties, preservation stability, charging stability, durability of one-component developer, and image reproducibility were evaluated in the following manners.

[Long-Term Use Stability]

Commercially-available copiers: MX-4500 (trade name) manufactured by Sharp Corporation were filled with the two-component developers obtained Examples 1 to 31 and Comparative examples 1 to 4, respectively, and then operated to print images in the condition that an amount of the toner to be attached onto a photoreceptor is adjusted to 0.4 mg/cm$^2$. Initial image density ($ID_0$) and image density ($ID_{10k}$) after 10,000 (hereinafter referred to as "10 k") sheet-printing, were measured by a calorimeter: X-Rite 938 (trade name) manufactured by X-Rite Inc. The image density ($ID_0$) and the image density ($ID_{10k}$) after 10 k sheet-printing were compared to each other, and a two-component developer with lesser variation between these densities was determined as having higher long-term use stability. As an index for the variation in image density, a stability rate (%) was employed.

$$\text{Stability rate (\%)}=(ID_{10k}/ID_0)\times 100 \quad (5)$$

The long-term use stability was evaluated according to the following evaluation criteria.

Good: Favorable. The stability rate was 90% or more.

Normal: Usable. The stability rate was 80% or more and less than 90%.

Poor: Defective. The stability rate was less than 80%.

[Fixing Property]

Using a remodeled commercially-available copiers: MX-4500 (trade name) manufactured by Sharp Corporation were filled with the two-component developers obtained Examples 1 to 31 and Comparative examples 1 to 4, respectively, and then operated to form unfixed images on recording mediums, i.e., recording sheets that were specifically PPC sheets: SF-4AM3 (trade name) manufactured by Sharp Corporation, from sample images each containing a rectangular solid image part of 20 mm in height by 50 mm in width so that an amount of unfixed toner in the solid image part to be attached to the recording sheet was adjusted to be 0.5 mg/cm$^2$. The unfixed images were then formed into fixed images by use of an external fixing device created from a fixing section of a color multifunctional peripheral. A processing speed for fixing was set at 124 mm/sec, and a temperature of a fixing roller was increased from 130° C. by 5° C. at a time. A temperature range causing neither low-temperature offset nor high-temperature offset was determined as a fixing non-offset range (° C.).

To be specific, the fixing non-offset range was determined according to the following expression (6).

$$\text{(Fixing non-offset range [° C.])}=\text{(High-temperature offset-causing temperature [° C.])}-\text{(Low-temperature offset-causing temperature [° C.])} \quad (6)$$

In the present embodiment, the high-temperature offset and the low-temperature offset were defined as follows. As some toner is unfixed to the recording sheet during the fixing operation and remains on a fixing roller, the toner may be attached to the recording sheet after the fixing roller goes into a 360-degree roll with the toner. This situation was referred to as occurrence of offset.

The fixing property was evaluated according to the following evaluation criteria.

Good: Favorable. The fixing non-offset range covered temperatures of 45° C. or higher.

Normal: Usable. The fixing non-offset range covered temperatures of 35° C. or higher and lower than 45° C.

Poor: Defective. The fixing non-offset range covered temperatures lower than 35° C.

[Preservation Stability]

In the present embodiment, the preservation stability of the toner is indicated by a difference in bulk density of between the toner before being left in an environment of 50° C. in temperature and 10% in relative humidity, and the toner after having been left in that environment. For example, when a toner having poor preservation stability is left for a while, then it will have increased adherence to the carrier and deteriorate the flowability of the developer. The developer having decreased flowability will cause blocking and makes it harder for the toner particles to flow in between other toner particles, leading to lower bulk density. Bulk density of the toner is measured in the following manner.

Of the toners obtained in Examples 1 to 3 and Comparative examples 1 to 4, 28 g to 30 g were each put in a 50 ml-polyethylene bottle. The polyethylene bottles with their lids closed were put in a thermo-hygrostat maintaining 50° C. and 10% RH. The polyethylene bottles were taken out after 72 hours, and by using a bulk specific gravity tester manufactured by Tsutsui Scientific Instruments Co., Ltd., bulk density of each toner was measured in accordance with JIS K-5101-12-1. The initial bulk density, i.e. the bulk density measured before leaving the toner, and the bulk density measured after a lapse of 72 hours were compared with each other. A toner less fluctuating in bulk density was determined as having better preservation stability. As an index for the variation in bulk density, a stability rate (%) was employed.

The stability rate (%) was determined by calculating the following expression (7).

$$\text{Stability rate (\%)}=\{\text{(Bulk density after 72 hours)}/\text{(Initial bulk density)}\}\times 100 \quad (5)$$

The preservation stability of the toner was evaluated according to the following evaluation criteria.

Good: Favorable. The stability rate was 90% or more.

Normal: Usable. The stability rate was 80% or more and less than 90%.

Poor: Defective. The stability rate was less than 80%.

[Charging Stability]

Commercially-available copiers: MX-4500 (trade name) manufactured by Sharp Corporation were filled with the two-component developers obtained Examples 1 to 31 and Comparative examples 1 to 4, respectively, and then operated to print 10 k copies of text charts each having a print ratio of 6%. After that, the charge amounts of the toners in the copiers were measured. Each toner charge amount at that point was defined as a toner charge amount. Q (μC/g) after 10 k sheet-printing. The charging stability of the developer is evaluated by comparison between the initial toner charge amount $Q_{ini}$ (μC/g) and the Q (μC/g) after 10 k sheet-printing, and as an index for the comparison between the toner charge amounts, a charge decrease rate (%) was employed. A lower charge decrease rate (%) indicates higher charging stability.

The charge amounts of the toners were measured as described below by using a charge amount measuring device: 210HS-2A (trade name) manufactured by Trek Japan K.K. Each two-component developer in a developing tank of the above copier was put into a metal container having a 500-mesh electrically-conductive screen at its bottom. Only the toner was thereafter suctioned by a suction machine at a suction pressure of 250 mmHg. And then, the charge amount of the toner was calculated on the basis of a weight difference between the before-suction mixture and the after-suction mixture, and a potential difference between electrode plates of a capacitor connected to the container.

The charge decrease rate was determined by calculating the following expression (8).

$$\text{Charge decrease rate (\%)}=100\times|(Q-Q_{ini})/Q_{ini}| \quad (8)$$

The charging stability of the toner was evaluated according to the following evaluation criteria.

Good: Favorable. The charge degrease rate was less than 10%.

Normal: Usable. The charge decrease rate was 10% or more and less than 20%.

Poor: Defective. The charge decrease rate was 20% or more.

[Durability of One-Component Developer]

Commercially-available copiers: MX-4500 (trade name) manufactured by Sharp Corporation were filled with the two-component developers obtained Examples 1 to 31 and Comparative examples 1 to 4, respectively, and then operated to print 20,000 (hereinafter referred to as "20 k") copies of white solid images in the thermoneutral environment with normal humidity. The white solid images indicate images which are obtained through the no-printing operation from paper feeding to fixing.

After 20 k sheet-printing, the toner remaining on a regulating blade in the developing device was blown way by a blower, and with an optical microscope, s surface of the regulating blade was observed; in other words, conditions of fixing and fusion bonding of the toner were observed on the regulating blade section. In addition, a transparent tape was attached to a peripheral surface of the developing roller, and this transparent tape was removed to be reattached onto a blank sheet so that presence or absence of white stripes would be visually checked.

The durability of the one-component developer was evaluated according to the following evaluation criteria.

Good: Favorable. No fixed or fusion-bonded toner was found on the regulating blade, and no white stripes were found.

Normal: Usable. A small amount of fusion-bonded toner was found on either ends of the regulating blade, or a small number of white stripes were found on either ends of the developing roller.

Poor: Defective. The fusion-bonded toner was found on an entire surface of the regulating blade, or white stripes were found.

[Image Reproducibility]

Color copiers: MX-4500 (trade name) manufactured by Sharp Corporation were filled with the two-component developers obtained Examples 1 to 31 and Comparative examples 1 to 4, respectively, and operated to print 10 k copies and then make a copy of a document having an original image drawn in exact-100 μm-wide thin lines, on a recycled paper sheet: RP100 (trade name) manufactured by Sharp document systems corporation, under a condition that an image having image-density of 0.3 or more and 0.5 or less can be formed from a 5 mm-diameter halftone image having image density of 0.3. A copied image was thus obtained. Note that the image density refers to optical reflection density measured by a reflection densitometer: RD-918 (trade name) manufactured by Macbeth Corporation.

Using image analysis software: A-ZO KUN (trade name) manufactured by Asahi Kasei Engineering Corporation, the thin lines formed in the copies image obtained were observed at 100-fold magnification. On the basis of a monitor image with such 100 times-enlarged thin lines, a line width of each of the thin lines formed in the copied image was measured by an indicator.

The thin line formed in the copied image had irregularities and therefore was different in width from one measurement position to another. The line width was thus measured at plural measurement positions, and their average was taken and determined as the line width formed in the copied image. The line width of the copied image was divided by 100 μm which was a line width of the original image, and a resultant value was multiplied by 100. A value thus obtained was determined as a value of thin line reproducibility. As this value of thin line reproducibility is closer to 100, it indicates better reproducibility of thin lines, more excellent image reproducibility, and higher resolution, which mean favorable image reproducibility.

The image reproducibility was evaluated according to the following evaluation criteria.

Good: Favorable. The value of thin line reproducibility was 95 or more and less than 110.

Normal: Usable. The value of thin line reproducibility was 110 or more and less than 125, or 90 or more and less than 95.

Poor: Defective. The value of thin line reproducibility was 125 or more, or less than 90.

[Comprehensive Evaluation]

The criteria for comprehensive evaluation were as follows.

Excellent: Favorable. Neither "Normal" nor "Poor" were given in the evaluation result.

Good: No problem in practical use. One "Normal" and no "Poor" were given in the evaluation result.

Normal: Slightly inferior. Two or more "Normal" were given in the evaluation result.

Poor: Defective. One or more "Poor" were-given in the evaluation result.

Table 3 shows the evaluation results and comprehensive evaluation results of the toners obtained in Examples 1 to 31 and Comparative examples 1 to 4 and the two-component developers containing these toners.

TABLE 3

| | Long-term use stability | | | | Fixing property | | | | Preservation stability | |
|---|---|---|---|---|---|---|---|---|---|---|
| | | | Stability rate | | Low-temperature offset-causing temperature | High-temperature offset-causing temperature | Fixing non-offset range | | Stability rate | |
| | $ID_0$ | $ID_{10K}$ | [%] | Evaluation | [° C.] | [° C.] | [° C.] | Evaluation | [%] | Evaluation |
| Ex. 1 | 1.53 | 1.49 | 97.4 | Good | 140 | 200 | 60 | Good | 94 | Good |
| Ex. 2 | 1.52 | 1.47 | 96.7 | Good | 140 | 210 | 70 | Good | 93 | Good |
| Ex. 3 | 1.50 | 1.46 | 97.3 | Good | 140 | 195 | 55 | Good | 94 | Good |
| Ex. 4 | 1.55 | 1.50 | 96.8 | Good | 140 | 190 | 50 | Good | 92 | Good |
| Ex. 5 | 1.53 | 1.45 | 94.8 | Good | 140 | 185 | 45 | Good | 91 | Good |
| Ex. 6 | 1.48 | 1.41 | 95.3 | Good | 140 | 205 | 65 | Good | 96 | Good |
| Ex. 7 | 1.52 | 1.42 | 93.4 | Good | 140 | 200 | 60 | Good | 94 | Good |
| Ex. 8 | 1.49 | 1.46 | 98.0 | Good | 140 | 200 | 60 | Good | 95 | Good |
| Ex. 9 | 1.53 | 1.49 | 97.4 | Good | 140 | 200 | 60 | Good | 92 | Good |
| Ex. 10 | 1.50 | 1.45 | 96.7 | Good | 140 | 190 | 50 | Good | 95 | Good |
| Ex. 11 | 1.51 | 1.46 | 96.7 | Good | 140 | 185 | 45 | Good | 94 | Good |
| Ex. 12 | 1.49 | 1.47 | 98.7 | Good | 140 | 200 | 60 | Good | 96 | Good |
| Ex. 13 | 1.54 | 1.49 | 96.8 | Good | 150 | 185 | 35 | Normal | 97 | Good |
| Ex. 14 | 1.48 | 1.44 | 97.3 | Good | 145 | 200 | 55 | Good | 87 | Normal |
| Ex. 15 | 1.51 | 1.3 | 86.1 | Normal | 140 | 200 | 60 | Good | 92 | Good |
| Ex. 16 | 1.51 | 1.45 | 96.0 | Good | 140 | 200 | 60 | Good | 94 | Good |
| Ex. 17 | 1.48 | 1.45 | 98.0 | Good | 140 | 200 | 60 | Good | 95 | Good |
| Ex. 18 | 1.47 | 1.46 | 99.3 | Good | 140 | 200 | 60 | Good | 93 | Good |
| Ex. 19 | 1.52 | 1.23 | 80.9 | Normal | 140 | 200 | 60 | Normal | 96 | Good |
| Ex. 20 | 1.47 | 1.4 | 95.2 | Good | 140 | 200 | 60 | Good | 95 | Good |
| Ex. 21 | 1.48 | 1.45 | 98.0 | Good | 140 | 200 | 60 | Good | 96 | Good |

TABLE 3-continued

| | | | | | | | | | | |
|---|---|---|---|---|---|---|---|---|---|---|
| Ex. 22 | 1.49 | 1.42 | 95.3 | Good | 140 | 200 | 60 | Good | 94 | Good |
| Ex. 23 | 1.52 | 1.48 | 97.4 | Good | 140 | 200 | 60 | Good | 94 | Good |
| Ex. 24 | 1.52 | 1.49 | 98.0 | Good | 140 | 200 | 60 | Good | 91 | Good |
| Ex. 25 | 1.52 | 1.46 | 96.1 | Good | 140 | 200 | 60 | Good | 94 | Good |
| Ex. 26 | 1.54 | 1.5 | 97.4 | Good | 140 | 200 | 60 | Good | 93 | Good |
| Ex. 27 | 1.49 | 1.44 | 96.6 | Good | 140 | 200 | 60 | Good | 94 | Good |
| Ex. 28 | 1.53 | 1.46 | 95.4 | Good | 140 | 200 | 60 | Good | 92 | Good |
| Ex. 29 | 1.53 | 1.45 | 94.8 | Good | 140 | 200 | 60 | Good | 93 | Good |
| Ex. 30 | 1.49 | 1.43 | 96.0 | Good | 140 | 200 | 60 | Good | 92 | Good |
| Ex. 31 | 1.50 | 1.45 | 96.7 | Good | 140 | 200 | 60 | Good | 97 | Good |
| Com. ex. 1 | 1.51 | 1.44 | 95.4 | Good | 150 | 180 | 30 | Poor | 93 | Good |
| Com. ex. 2 | 1.50 | 1.17 | 78.0 | Poor | 140 | 200 | 60 | Good | 68 | Poor |
| Com. ex. 3 | 1.54 | 1.49 | 96.8 | Good | 140 | 170 | 30 | Poor | 92 | Good |
| Com. ex. 4 | 1.54 | 1.1 | 71.4 | Poor | 160 | 180 | 20 | Poor | 84 | Normal |

| | Charging stability | | | | Durability of one-component developer | Image reproducibility | | |
|---|---|---|---|---|---|---|---|---|
| | Qini [μC/g] | Q [μC/g] | charge decrease rate [%] | Evaluation | Evaluation | Thin line reproducibility | Evaluation | Comprehensive evaluation |
| Ex. 1 | −28.8 | −26.9 | 6.6 | Good | Good | 102 | Good | Excellent |
| Ex. 2 | −28.5 | −27.2 | 4.6 | Good | Good | 103 | Good | Excellent |
| Ex. 3 | −28.6 | −26.8 | 6.3 | Good | Good | 101 | Good | Excellent |
| Ex. 4 | −29.3 | −27.5 | 6.1 | Good | Good | 102 | Good | Excellent |
| Ex. 5 | −29.0 | −28.1 | 3.1 | Good | Good | 104 | Good | Excellent |
| Ex. 6 | −28.3 | −24.7 | 12.7 | Normal | Good | 102 | Good | Good |
| Ex. 7 | −29.1 | −24.1 | 17.2 | Normal | Good | 103 | Good | Good |
| Ex. 8 | −28.4 | −25.9 | 8.8 | Good | Normal | 105 | Good | Good |
| Ex. 9 | −28.5 | −26.7 | 6.3 | Good | Good | 104 | Good | Excellent |
| Ex. 10 | −28.8 | −24.5 | 14.9 | Normal | Good | 104 | Good | Good |
| Ex. 11 | −29.1 | −27.8 | 4.5 | Good | Good | 103 | Good | Excellent |
| Ex. 12 | −28.5 | −27.5 | 3.5 | Good | Good | 102 | Good | Excellent |
| Ex. 13 | −29.3 | −28.0 | 4.4 | Good | Good | 101 | Good | Good |
| Ex. 14 | −30.2 | −26.1 | 13.6 | Normal | Good | 103 | Good | Good |
| Ex. 15 | −29.5 | −24.8 | 15.9 | Normal | Good | 111 | Normal | Normal |
| Ex. 16 | −29.1 | −27.4 | 5.8 | Good | Good | 103 | Good | Excellent |
| Ex. 17 | −28.4 | −27.8 | 2.1 | Good | Good | 103 | Good | Excellent |
| Ex. 18 | −28.6 | −27.4 | 4.2 | Good | Good | 102 | Good | Excellent |
| Ex. 19 | −28.9 | −24.5 | 15.2 | Normal | Good | 112 | Normal | Normal |
| Ex. 20 | −28.5 | −27.4 | 3.9 | Good | Good | 102 | Good | Good |
| Ex. 21 | −28.4 | −27.6 | 2.8 | Good | Good | 93 | Normal | Good |
| Ex. 22 | −29.5 | −27.0 | 8.5 | Good | Good | 104 | Good | Excellent |
| Ex. 23 | −29.6 | −27.9 | 5.7 | Good | Good | 112 | Normal | Good |
| Ex. 24 | −29.0 | −26.9 | 7.2 | Good | Good | 112 | Normal | Good |
| Ex. 25 | −28.9 | −27.4 | 5.2 | Good | Good | 113 | Normal | Good |
| Ex. 26 | −29.3 | −26.9 | 8.2 | Good | Good | 118 | Normal | Good |
| Ex. 27 | −28.4 | −25.4 | 10.6 | Normal | Good | 118 | Normal | Normal |
| Ex. 28 | −28.8 | −26.8 | 6.9 | Good | Good | 105 | Good | Excellent |
| Ex. 29 | −29.3 | −26.1 | 10.9 | Normal | Good | 106 | Normal | Good |
| Ex. 30 | −28.5 | −24.3 | 14.7 | Normal | Normal | 102 | Good | Good |
| Ex. 31 | −30.8 | −29.1 | 5.5 | Good | Good | 101 | Good | Excellent |
| Com. ex. 1 | −29.8 | −28.3 | 5.0 | Good | Good | 103 | Good | Poor |
| Com. ex. 2 | −29.5 | −15.5 | 47.5 | Poor | Poor | 125 | Poor | Poor |
| Com. ex. 3 | −28.0 | −26.3 | 6.1 | Good | Good | 103 | Good | Poor |
| Com. ex. 4 | −28.4 | −13.3 | 53.2 | Poor | Poor | 132 | Poor | Poor |

The above results revealed that in each of Examples 1 to 31, the flowability of the developer can be prevented from decreasing with time during a long-term use, and the fixing property can be maintained, thus allowing for formation of high-quality images with high definition and high resolution. In Examples 15 and 19 where the coverage of the external additive was out of the determined range, the flowability of the developer decreased slightly with time during a long-term use, and so did its long-term use stability and image reproducibility. In Example 6 where the dispersion diameter of the release agent was out of the determined range, the flowability of the developer decreased slightly, and so did its charging stability. In Example 13 where the acid value of the binder resin was out of the determined range, the fixing property decreased slightly. In Example 14 where the acid value of the binder resin was out of the determined range, the charging stability decreased slightly. In Example 20 where all particles were spheronized, the charging stability decreased slightly. In Example 21 with no spheronizing process and Examples 23 to 26 where the added amount of the second toner particle group was greater than the more preferable range, the image reproducibility decreased slightly. In Example 27 where the added amount of the second toner particle group was greater than the preferable range, the image reproducibility decreased slightly. In Example 29 where the added amount of the second toner particle group was smaller than the preferable range, the charging stability decreased slightly.

In present Examples, a magenta toner was used as a toner. This is because C.I. pigment red 57:1 adapted for magenta was contained as colorant. Note that instead of the colorant, any one of the variety of colorants listed above may be used to implement the inventions in the same manner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising at least a binder resin, a colorant, and a release agent, wherein an acid value of the release agent is less than 4.0 mgKOH/g, and an amount of the release agent exposed on a surface of the toner is 0.5% by weight or more and 2.5% by weight or less of a total amount of the toner, the toner being formed by mixing a first toner particle group and a second toner particle group having a greater volume average particle size than a volume average particle size of the first toner particle group; and the second toner particle group is spheronized, but the first toner particle group is not spheronized.

2. The toner of claim 1, wherein the release agent in the surface of the toner has a dispersion diameter of less than 300 nm.

3. The toner of claim 1, wherein at least a part of the surface of the toner is covered.

4. The toner of claim 3, wherein at least a part of the surface of the toner is encapsulated.

5. The toner of claim 1, wherein the binder resin has an acid value of 5 mgKOH/g or more and 30 mgKOH/g or less.

6. The toner of claim 1, wherein the toner further comprises an external additive, which external additive covers 50% or more and less than 120% of surface area of the toner.

7. A method of manufacturing the toner of claim 1, comprising:

a pulverizing step of pulverizing a resin composition containing at least a binder resin, a colorant, and a release agent into a first pulverized product and a second pulverized product having a greater volume average particle size than a volume average particle size of the first pulverized product;

a first classifying step of classifying the first pulverized product into a first toner particle group;

a second classifying step of classifying the second pulverized product into a second toner particle group having a greater volume average particle size than a volume average particle size of the first toner particle group;

a mixing step of mixing the first toner particle group and the second toner particle group; and a spheronizing step of spheronizing at least either the second pulverized product or the second toner particle croup while neither the first pulverized product nor the first toner particle croup is spheronized.

8. The method of claim 7, wherein a weight ratio of the second toner particle group mixed in the mixing step is 5 parts by weight or more and 120 parts by weight or less to 100 parts by weight of the first toner particle group.

9. The method of claim 7, wherein a weight ratio of the second toner particle group mixed in the mixing step is 5 parts by weight or more and 70 parts by weight or less to 100 parts by weight of the first toner particle group.

10. A developer comprising the toner of claim 1.

11. A two-component developer comprising the toner of claim 1 and a carrier.

12. The two-component developer of claim 11, wherein the carrier has a volume average particle size of 30 μm or more and 50 μm or less.

* * * * *